US012790732B2

(12) United States Patent
Almroth et al.

(10) Patent No.: US 12,790,732 B2
(45) Date of Patent: Nov. 10, 2026

(54) GENERATING THREAD STITCH COLORING DATA FOR AN IN-LINE THREAD COLORING PROCESS

(71) Applicant: COLOREEL INTERNATIONAL HOLDINGS LIMITED, Hong Kong (CN)

(72) Inventors: Michael Almroth, Hong Kong (CN); Joakim Staberg, Hong Kong (CN)

(73) Assignee: COLOREEL INTERNATIONAL HOLDINGS LIMITED, Hong Kong (CN)

( * ) Notice: Subject to any disclaimer, the term of this patent is extended or adjusted under 35 U.S.C. 154(b) by 0 days.

(21) Appl. No.: 19/110,290

(22) PCT Filed: Sep. 14, 2023

(86) PCT No.: PCT/SE2023/050902
§ 371 (c)(1),
(2) Date: Mar. 10, 2025

(87) PCT Pub. No.: WO2024/058703
PCT Pub. Date: Mar. 21, 2024

(65) Prior Publication Data

US 2026/0085459 A1 Mar. 26, 2026

(30) Foreign Application Priority Data

Sep. 14, 2022 (SE) ..... 2251062-2

(51) Int. Cl.
*D05B 67/00* (2006.01)
*D04B 35/22* (2006.01)

(52) U.S. Cl.
CPC ..... *D05B 67/00* (2013.01); *D04B 35/22* (2013.01)

(58) Field of Classification Search
CPC ..... D05B 67/00; D05B 35/22; B65H 71/00; D05C 11/24; D05C 5/00; D05C 5/02; D05C 7/00; D05C 11/06; D05C 13/00
(Continued)

(56) References Cited

U.S. PATENT DOCUMENTS 6,189,989 B1 * 2/2001 Hirabayashi ..... D05C 11/24 427/288
6,196,146 B1 * 3/2001 Goldberg ..... D05B 19/10 705/26.1
(Continued)

FOREIGN PATENT DOCUMENTS

CN 107012601 A 8/2017
CN 110129974 B * 7/2023 ..... D04B 15/32
(Continued)

OTHER PUBLICATIONS

International Search Report and Written Opinion of International Application No. PCT/SE2023/050902 dated Oct. 30, 2023, 11 pp.
(Continued)

*Primary Examiner* — Danny Worrell
(74) *Attorney, Agent, or Firm* — Shumaker & Sieffert, P.A.

(57) ABSTRACT

A computer-implemented method for generating thread stitch coloring data for an in-line thread coloring process, comprising: obtaining first thread stitch coloring data based on a digital representation that is to be produced as a decorative thread pattern; obtaining at least one thread color boundary defining a color change from a first color to a second color; determining residual stitch data based on the at least one thread color boundary being indicative of a number of residual stitches required in order to carry out said color change in an in-line thread coloring process; and generating second thread stitch coloring data based on the residual stitch data such that the color change of the first
(Continued)

thread stitch coloring data is accounted for in the in-line thread coloring process.

18 Claims, 12 Drawing Sheets

(58) Field of Classification Search
USPC ..... 700/136–138
See application file for complete search history.

(56) References Cited

U.S. PATENT DOCUMENTS

| | | | | |
|---|---|---|---|---|
| 11,585,027 | B2 * | 2/2023 | Moshe | D06B 11/0023 |
| 2005/0171628 | A1 * | 8/2005 | Suzuki | D05B 19/08 112/102.5 |
| 2007/0245940 | A1 | 10/2007 | Wahlstrom | |
| 2012/0143717 | A1 * | 6/2012 | Gardner | G06Q 30/0621 112/102.5 |
| 2014/0318430 | A1 | 10/2014 | Kato et al. | |
| 2020/0332446 | A1 | 10/2020 | Moshe et al. | |
| 2020/0399804 | A1 | 12/2020 | Kamihira et al. | |
| 2022/0106720 | A1 | 4/2022 | Gotoh et al. | |
| 2022/0120001 | A1 | 4/2022 | Vlandis et al. | |
| 2023/0392312 | A1 * | 12/2023 | Ishii | D05C 13/02 |
| 2023/0416961 | A1 * | 12/2023 | Gotoh | D05B 19/08 |
| 2026/0015781 | A1 * | 1/2026 | Eklind | D06B 11/0023 |

FOREIGN PATENT DOCUMENTS

| | | | | |
|---|---|---|---|---|
| EP | 3978673 | A1 * | 4/2022 | D05C 11/24 |
| JP | 2022058181 | A | 4/2022 | |
| JP | 2022060156 | A | 4/2022 | |
| SE | 1851096 | A1 | 3/2020 | |
| SE | 543374 | C2 | 12/2020 | |
| WO | 2016204686 | A1 | 12/2016 | |
| WO | 2016204687 | A1 | 12/2016 | |

OTHER PUBLICATIONS

Search Report from counterpart Swedish Application No. 2251062-2 dated Mar. 28, 2024, 3 pp.

Extended Search Report from counterpart European Application No. 23865957.7 dated Jul. 9, 2026, 6 pp.

First Office Action and Search Report, and translation thereof, from counterpart Application No. 202380066081.2 dated Jul. 22, 2026, 9 pp.

* cited by examiner

GENERATING THREAD STITCH COLORING DATA FOR AN IN-LINE THREAD COLORING PROCESS

This application is a national stage entry of International Patent Application No. PCT/SE2023/050902, filed 14 Sep. 2023, which claims the benefit of SE Patent Application No. 2251062-2, filed 14 Sep. 2022, the entire content of each application is incorporated herein by reference.

TECHNICAL FIELD

The present disclosure relates to the technical field of thread consuming devices. In particular, the present disclosure relates to a computer-implemented method for generating thread stitch coloring data for an in-line thread coloring process. The disclosure further relates to an associated system, non-transitory computer-readable storage medium, and computer program product.

BACKGROUND

Thread consuming devices, such as embroidery machines, have traditionally relied on pre-colored threads, limiting design creativity and causing operational inefficiencies due to, for instance, frequent thread changes. In-line thread coloring technology offers a solution by coloring thread during consumption, enabling versatile designs with fewer thread changes. However, it has been proven difficult to handle color transitions in in-line thread coloring processes. Such challenges pertain to ensuring consistent color changes, timing synchronization with the thread consumption device, providing precise color calibration, maintaining thread quality, integrating with existing machinery, to name a few.

The present inventors have identified the above mentioned deficiencies of the prior art and have insightfully come up with a solution.

SUMMARY

An object of the present disclosure is therefore concerned with managing color transitions of an in-line thread coloring process. In order to reproduce a decorative pattern using an embroidery device, newer types of embroidery devices include computerized controllers adapted to receiving thread stitch coloring data, for instance via a computer file of a given format. The thread stitch coloring data is then processed such that it may be identified where the particular decorative pattern changes color, for instance by analyzing respective color values and positions of pixels of the thread stitch coloring data. The computerized controllers then proceeds by determining where portions of thread are to be cut for purposes of switching between various thread source representations each being associated with a particular thread color representation. By way of this control procedure, the embroidery device may be controlled to perform color transitions by appropriately switching between a plurality of pre-colored thread sources such that the decorative pattern may be reproduced onto a substrate.

Since in-line thread coloring devices utilize a single thread source having a single color (typically white) which is being colored while the thread is being consumed in the embroidery device, the above control procedure does not provide a satisfying result in contexts of in-line thread coloring processes. In order to provide a reproduction of the decorative pattern using an line thread coloring device, it is important that the color transitions are managed appropriately, otherwise color substances may be smeared out. Smeared colors during color transitions are undesirable because they reduce embroideries' visual appeal, precision, and professionalism, potentially leading to production inefficiencies and lower-quality outcomes. Ultimately, the coloring quality and thus the embroidery results becomes poorer.

The present inventors have realized that color transitions can be controlled by a computer-controlled process by monitoring thread color boundaries that define color changes and accordingly convert first thread stitch coloring data into second thread stitch coloring data, where the second thread stitch coloring data takes into account residual stitches required for carrying out said color change.

In a first aspect of the present disclosure there is thus provided a computer-implemented method for generating thread stitch coloring data for an in-line thread coloring process. The method comprises obtaining first thread stitch coloring data based on a digital representation that is to be produced as a decorative thread pattern, the first thread stitch coloring data having a set of color representations assigned to a corresponding set of thread source representations; obtaining at least one thread color boundary from the first thread stitch coloring data, each thread color boundary defining a color change from a first color to a second color among said set of color representations; determining residual stitch data based on the at least one thread color boundary, the residual stitch data being indicative of a number of residual stitches required in order to carry out said color change in an in-line thread coloring process; and generating second thread stitch coloring data based on the residual stitch data such that the color change of the first thread stitch coloring data is accounted for in the in-line thread coloring process, the second thread stitch coloring data having a set of color representations assigned to a single thread source representation.

The first aspect enables conversion of thread stitch coloring data from a traditional embroidery file, i.e., adapted for a non-in-line thread coloring process, to thread stitch coloring data applicable for an in-line thread coloring process. It shall thus be understood that the first thread stitch coloring data is thread stitch coloring data adaptable for a traditional embroidery device employing a plurality of pre-colored thread sources, while the second thread stitch coloring data is thread stitch coloring data adaptable for an in-line embroidery device. The conversion effectively takes into account the required residual stitches that inevitably arise due to the coloring switch from one or more first colors to one or more second colors. By including the residual stitch data of said residual stitches required for carrying out the color change into the second thread stitch coloring data. Additional technical advantages may be envisaged from one or more of the following examples.

In some examples, the residual stitch data is determined by estimating a number of residual stitches adapted to be carried out on a residual substrate different from a substrate where the decorative thread pattern is to be produced.

In some examples, the substrate is adapted to be received by a main frame and the residual substrate is adapted to be received by at least one sub-frame.

In some examples, the residual stitch data is determined by estimating a number of residual stitches adapted to be carried out as underlay stitches on a substrate where the decorative thread pattern is to be produced.

In some examples, the estimation of the number of residual stitches depends on one or more operating conditions of the in-line thread coloring process.

In some examples, determining the residual stitch data comprises defining a thread color boundary range indicating a range of residual stitches having intermediary colors between the first color and the second color, the thread color boundary range having a starting value being indicative of an initiation of the color change, and an end value being indicative of a completion of the color change.

In some examples, the method further comprises setting a respective buffer to each one of the starting value and the end value, the buffers indicating additional number of stitches to the residual stitch data on a respective end of the thread color boundary range.

In some examples, the thread color boundary range is dependent on one or more of a number of stitches, an amount of consumed thread, a substrate property, a thread property, and a combination thereof.

In some examples, said color change is caused by one or more of a color transition in the digital representation, a cutting process of a thread, a relative movement of a substrate, and a combination thereof.

In some examples, the residual stitch data comprises information of one or more of a length of the color change, a direction of the color change colors used for carrying out said color change, a substrate property where the color change is to be carried out, a thread property of the thread to be used for carrying out the color change, and a combination thereof.

In some examples, a subsequent consumption of a thread source in said in-line thread coloring process comprises, based on the second thread stitch coloring data, causing control of the in-line thread coloring process by: controlling an in-line thread coloring process of a thread; controlling a thread consumption process of a thread with respect to a substrate; and controlling a residual embroidery process of the thread as one or both of residual stitches onto a residual substrate different from the substrate, and residual stitches as underlay stitches onto the substrate.

In some examples, generating the second thread stitch coloring data comprises: obtaining pattern data from the digital representation, the pattern data comprising a plurality of pixels, each pixel being associated with a position in the digital representation and a color value; generating resolution data by processing the pattern data, wherein processing the pattern data comprises determining a thread arrangement comprising a plurality of stitches, wherein the entire thread arrangement corresponds to a digital representation to be produced in the in-line thread coloring process; and generating the second thread stitch coloring data for the thread at least based on said resolution data.

In some examples, processing the pattern data further comprises determining information relating to the length of the stitches, the direction of the stitches and the type of connection used to connect one or more stitches to each other.

In a second aspect of the present disclosure, a control unit is provided. The control unit comprises a processor configured to carry out the steps of the method of the first aspect.

In a third aspect of the present disclosure, a system for in-line treatment of at least one thread for use with a thread consuming device is provided. The system comprises a treatment unit comprising at least one a discharge device comprising at least one nozzle, arranged along the at least one thread, being configured to dispense one or more coating substances onto the thread when activated; and a control unit configured to control the discharge device to dispense the coating substances onto the at least one thread based on the second thread stitch coloring data generated from the method of the first aspect.

In a third aspect of the present disclosure, a non-transitory computer-readable storage medium is provided. The storage medium comprises instructions, which when executed by one or more processors of a control unit, cause the processor to perform the functionality of the method of the first aspect.

In a second aspect of the present disclosure, a computer program product is provided. The computer program product comprises computer code for performing the functionality of the method of the first aspect.

The term thread consuming device is in this context any apparatus which in use consumes thread. It may e.g., be an embroidery machine, weaving machine, sewing machine, knitting machine, weaving machine, a tufting machine, a thread winding machine or any other thread consuming apparatus which may benefit from a surface treatment or coating or any other process involving subjecting the thread to a substance, such as dying.

The term treatment is in this context any process designed to cause a change of the properties of a thread. Such processes include, but are not limited to, coloring, wetting, lubrication, cleaning, fixing, heating, curing, dying, etc.

The term representations of various units is in this context digitalized representations of said unit. Hence, a digital representation of a decorative thread pattern is data that digitally represents said thread pattern, including e.g., pixels and related data. Moreover, a color representation is interpreted as how an actual color is represented in a digital format. For instance, the color representation may include RGB color values. Further, a thread source representation is a digital representation of a thread source, such as a thread reel. For instance, the thread source may be digitally represented as a data structure with arbitrary units of length data pertaining to the actual length of a corresponding physical thread source.

The term residual stitch is in this context stitches that are not visually presented in the decorative pattern. In some examples the residual stitches are interpreted as underlay stitches, i.e., stitches located at a side of a substrate opposing the side thereof where the decorative pattern is visually presented. In some examples the residual stitches are interpreted as "trash" or "waste" stitches, i.e., stitches being made to a substrate different from the substrate used for producing the decorative thread pattern. Other similar interpretations of a residual stitch other than underlay or waste stitches may be readily envisaged, with the fundamental idea that it is not visually distinguishable by a pair of human's eyes. Correspondingly, the term residual stitch data is digitalized data pertaining to the residual stitches which, for instance, digitally defines various properties of the physical stitches.

Within this specification, all references to upstream and/or downstream should be interpreted as relative positions during normal operation of the thread consuming device, i.e. when the device is operating to treat an elongated substrate, such as a thread, continuously moving through the device in a normal operating direction. Hence, an upstream component is arranged such that a specific part of the thread passes it before it passes a downstream component.

BRIEF DESCRIPTION OF THE DRAWINGS

Examples of the disclosure will be described in the following description; reference being made to the appended drawings which illustrate non-limiting examples of how the inventive concept can be reduced into practice.

DETAILED DESCRIPTION

Figure 1:
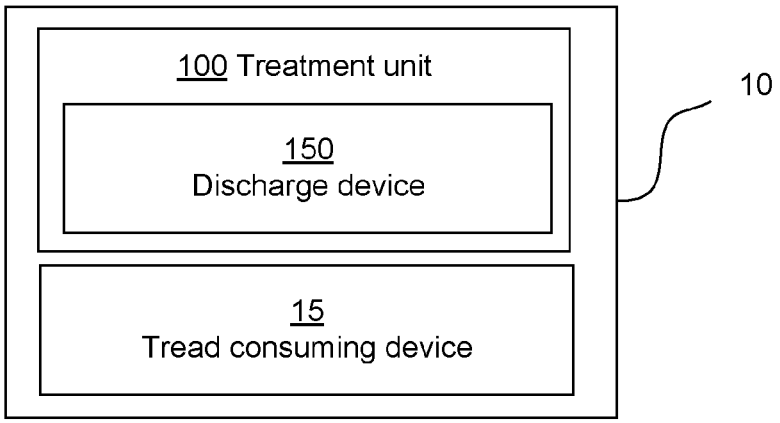
FIG. 1 is a schematic view of a system for in-line treatment of thread according to one example.

FIG. 1 is a schematic view of system 10 for in-line treatment of thread. The system 10 comprises a treatment unit 100 having a discharge device 150 configured for dispensing one or more coating substances onto at least one thread. The system 10 is connected to at least one thread consuming device 15, which may e.g., be in the form of one or several embroidery machine(s), a weaving machine(s), a sewing machine(s), knitting machine(s), a tufting machine (s), a thread winding machine(s), etc. Hereinafter, the thread consuming device may in various examples be referred to as an embroidery machine. The system 10 thereby forms a thread consuming unit, including the at least one embroidery machine 15 and the treatment unit 100. It should be noted that more than one thread can be used in the thread consuming device(s).

The treatment unit 100 allows the embroidery machine 15 to operate without the provision of uniquely pre-colored threads, as is required for conventional thread consuming devices. Instead, the treatment unit 100 provides in-line coloring of a thread in accordance with predetermined coloring patterns, such that a colored embroidery can be produced. The treatment unit 100 thus replaces individual thread reels each having a pre-colored thread, as is present in traditional systems of the prior art of consuming a thread.

Figure 2:
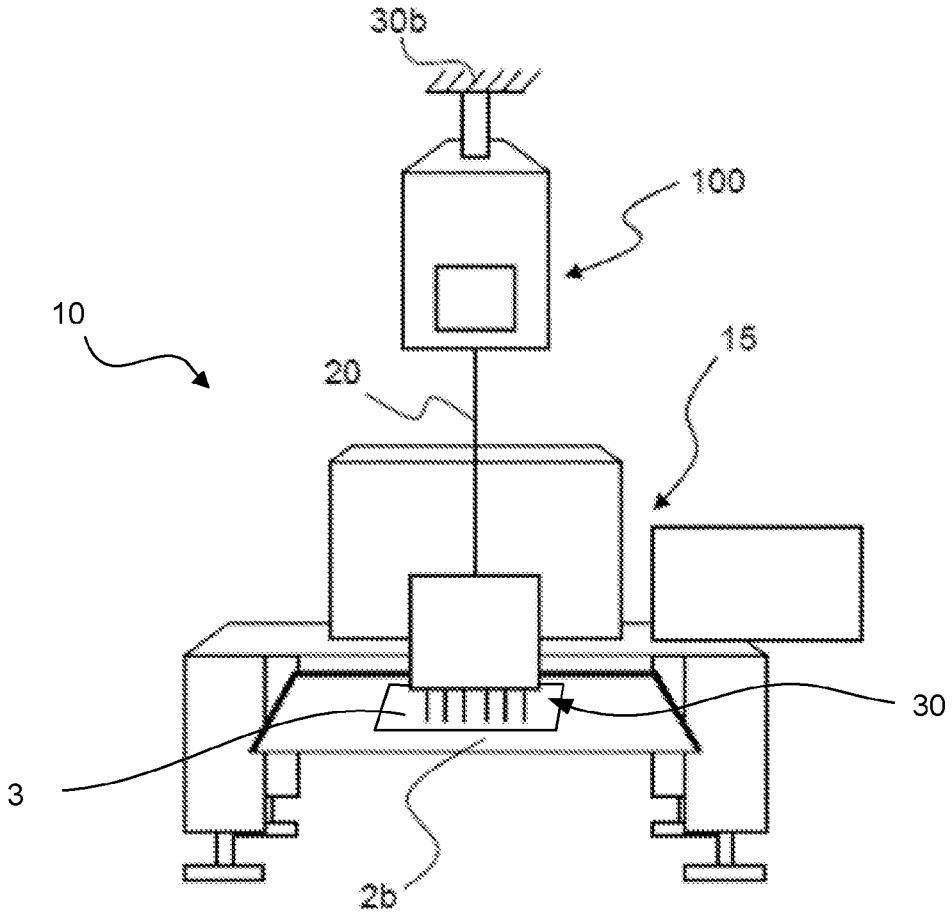
FIG. 2 is a perspective view of a system having a thread consuming device, an embroidery frame and a treatment unit according to one example.

FIG. 2 exemplifies the thread consuming device 15 is as an embroidery machine, here illustrated as a single-head embroidery machine, being equipped with a treatment unit 100. The embroidery machine 15 may comprise a moveable stage 2*b* carrying a substrate 3 to be embroidered. During operation the moveable stage 2*b* may be controlled to change its position in the X and Y direction (i.e. in this case the horizontal plane, but it could also be in the vertical plane). The speed of the moveable stage 2*b* may be controlled in accordance with the operation of the embroidery machine 15. In some examples, the substrate 3 that is to be applied with the thread 20 is arranged in a frame 30. If a moveable stage 2*b* is present, a frame 30 may be arranged on top of the stage 2*b*. Embodiments of such a frame 30 will be described more in detail later on in this disclosure.

The substrate 3 is preferably a textile, fabric or cloth. In some examples, the substrate 3 has a fixed set of properties, for example a specific thickness or elasticity constant. The substrate 3 may be divided into different sections where each section may have different properties relating to for example the thickness and/or elasticity of the substrate 3.

Figure 3:
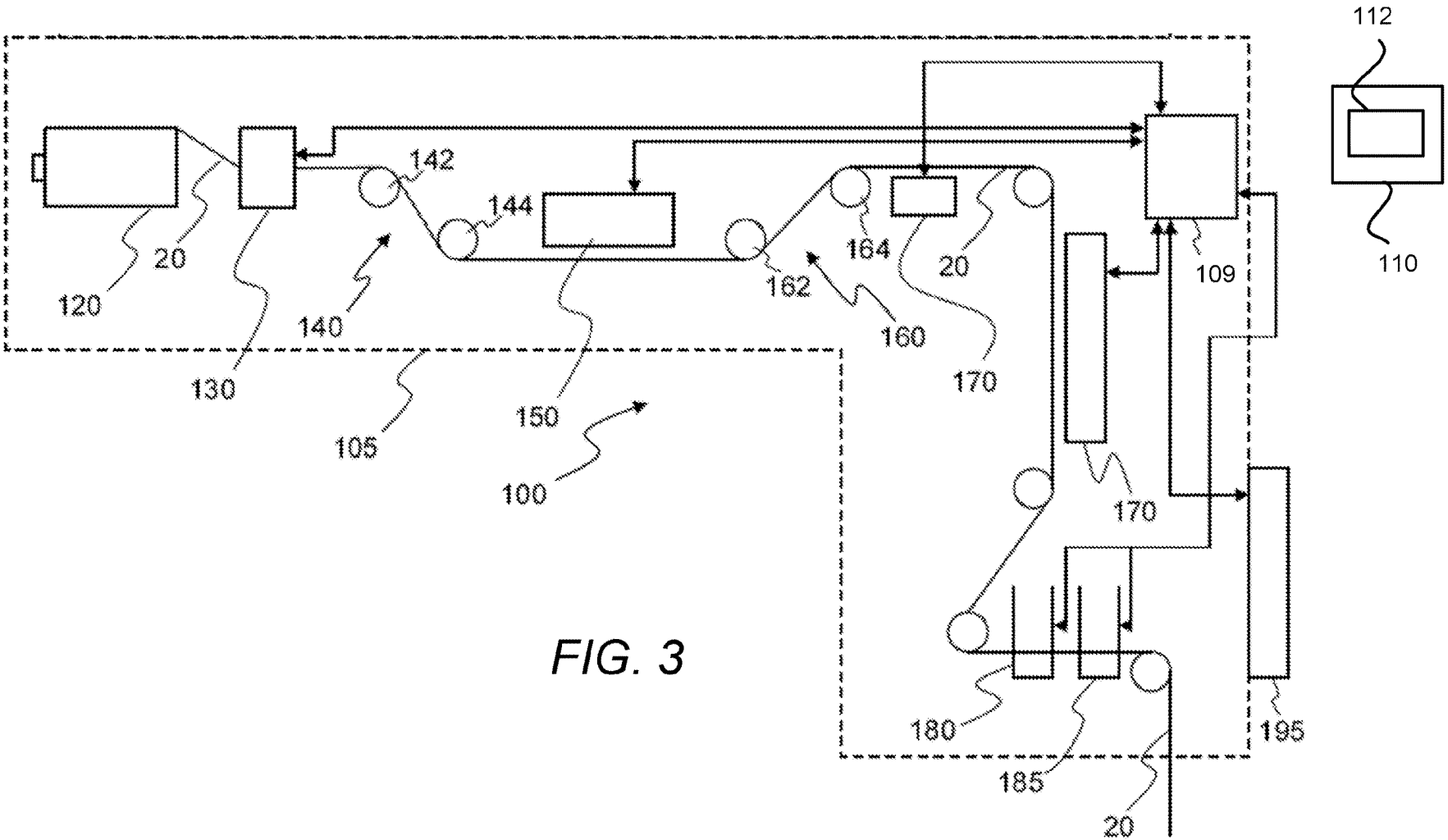
FIG. 3 is a schematic view of a treatment unit for use with a system according to one example.

FIG. 3 shows various components of the treatment unit 100 according to one example. It is envisaged that other examples may include fewer, additional or alternative components than those shown in the figure. A majority of the components are arranged inside a housing 105. Immediately downstream a thread reel 120 a thread feeder 130 may be arranged, which is configured to pull the thread forward through the treatment unit 100. The thread feeder 130 is not described further herein, but generally the thread feeder 130 is arranged to receive one or more threads 20 from the thread reel 120 and forward the thread 20 to other components of the treatment unit 100. The thread feeder 130 is controlled by a control unit 109. The thread feeder 130 is preferably also configured to control the thread tension, e.g., by means of a driven roller, an encoder wheel, and/or one or more thread guides. After passing the thread feeder 130 the thread 20 engages with a thread guiding device 140.

The thread guiding device 140, which may e.g., be in the form of one or more guiding rollers 142, 144 or other suitable means, is ensuring that the thread 20 is aligned with one or more treatment nozzles forming part of discharge device 150.

The discharge device 150 is configured to discharge treatment substance, such as a coloring substance, onto the thread 20 as it passes the discharge device 150. For this the nozzles are preferably arranged in the longitudinal direction of the thread 20. The discharge device 150 may be moveable by means of a drive unit (not shown). Having a drive unit will make it possible to arrange the discharge device 150 in different operating states in order to perform different tasks, such as for example a first state of dispensing a coating substance to a thread and a second state of performing a cleaning session, or other maintenance or idling. For this a drive unit may be connected to the discharge device 150. The drive unit may be configured to move the discharge device 150 between an idle position and an operational position by means of a transmission having different transmission ratios during the motion from the idle position towards the operational position.

Downstream the discharge device 150 another thread guiding device 160 may be provided. The second thread guiding device 160 is cooperating with the first thread guiding device 140 such that the position of the thread 20 is correct during its travel along the discharge device 150. The second thread guiding device 160 may e.g., be in the form of one or more guiding rollers 162, 164, although it may also be designed to induce a rotation of the thread 20 along its longitudinal axis.

The treatment unit 100 may further comprise a thread speed sensor (not shown) configured to measure the speed of the thread 20 passing through the treatment 10. The thread speed sensor may be arranged outside or within the housing 105. The thread speed sensor may be arranged just before the discharge device 150. The thread speed sensor may in some examples replace or complement the thread guiding device 140. In some examples, the thread speed sensor may be arranged just after the discharge device 150. The thread speed sensor may in some examples replace or complement the second thread guiding device 160. In yet some examples, two thread sensors are provided, the first arranged before the discharge device 150 and the second arranged after the discharge device 150, e.g., as the first and second thread guiding devices 140, 150.

The thread 20 is then fed forward to pass one or more fixation units 170 which are provided in order to fixate the treatment substance to the thread 20. The fixation unit 170 preferably comprises heating means, such as a hot air supply or heated elements, or an UV light source such that the treatment substance, e.g., a coloring substance, is cured or fixated onto the thread 20. The fixation unit 170 may either be arranged horizontally, vertically, or at an angle between horizontally and vertically.

Before exiting the housing 105 the thread 20 can pass a cleaning unit 180, such as an ultrasonic bath, where unwanted particles are removed from the thread 20. As the treatment substance is fixated onto the thread 20, the cleaning unit 180 will leave the treatment substance unaffected.

The treatment unit 100 may further comprise a lubrication unit 185 arranged inside the housing 105. Additional thread buffers and feeders (not shown) may also be included in the treatment unit 100, arranged at various positions in the thread path.

The thread 20 preferably exits the treatment unit 100 through an aperture or similar, whereby the thread 20 is forwarded to an associated thread consuming device, such as the embroidery machine 15.

The thread feeder 130 and the other components engaging with the thread 20 during operation are preferably configured such that the force required to pull the thread 20 from the treatment unit 100, i.e. the pulling force applied by the downstream embroidery machine 15, is approximately the same as if the treatment unit 100 was replaced by prior art thread reels.

A control unit 109 with associated electronics, such as power electronics, communication modules, memories, etc., is also provided. The control unit 109 is connected to the thread feeder 130, the discharge device 150, and the fixation unit 170 for allowing control of the operation of these components. Further, the control unit 109 is configured to controlling operation of the entire treatment unit 100 including the cleaning unit 180, the lubrication unit 185, a disruption of the thread 20, the thread speed at various position along the treatment unit 100, the thread buffers, etc. The control unit 109 may also be configured to receive control signals from one or more components of the treatment unit 100, e.g., control signals for triggering specific control, or other information relating to e.g., thread consumption by the embroidery machine 15. The control unit 109 is also configured to receive information from a second control unit 110, as soon will be described more in detail.

The control unit 109 may comprise one or more processors configured to be implemented by any commercially available CPU ("Central Processing Unit"), DSP ("digital signal processor") or any other electronic programmable logic device, or a combination of such processors or other electronic programmable logic device. The control unit 109 may be implemented using instructions that enable hardware functionality, for example, by using executable computer program instructions in a general-purpose or special-purpose processor that may be stored on a computer readable storage medium (disk, memory, etc.) to be executed by such a processor.

In some examples, a user interface is also provided, preferably via a display 195 arranged at the front end of the housing 105. The display 195 allows a user to interact with the control unit 109 and is thus connected thereto, so that the control parameters of the thread feeder 130, the discharge device 150, the fixation unit 170, etc. may be set depending on process specifications. The display 195 may also be used for alerting the user of critical situations, whereby the display 195 may be used for the control unit 109 to issue alarms or the like.

The control unit 109 may be configured to receive digital content. Digital content may be a photography captured by a camera unit, included in or provided external to the system 300. The digital content may alternatively be virtually rendered by the control unit or some other type of device capable of rendering digital content.

The control unit 109 may be configured to communicate in any known short-range or long-range communication standards known in the art via a communication interface. Short-range communication interfaces include, for instance, IEEE 802.11, IEEE 802.15, ZigBee, WirelessHART, WiFi, Bluetooth®, BLE, RFID, QR, WLAN, MQTT IoT, CoAP, DDS, NFC, AMQP, LoRaWAN, Z-Wave, Sigfox, Thread, EnOcean, mesh communication, or any other form of proximity-based device-to-device radio communication signal such as LTE Direct. Long-range communication interfaces include, for instance, W-CDMA/HSPA, GSM, UTRAN or LTE.

A memory unit (not shown) may be associated with the control unit 109, for instance reside therein, and implemented in any known memory technology, including but not limited to E(E)PROM, S(D)RAM or flash memory. The memory unit may alternatively be a cloud storage unit. The cloud storage unit may be deployed as a SQL data model such as MySQL, PostgreSQL or Oracle RDBMS. Alternatively, deployments based on NoSQL data models such as MongoDB, Amazon DynamoDB, Hadoop or Apache Cassandra may be used. Alternatively, the memory unit may reside in an external server configured in any type of client-server or peer-to-peer (P2P) computer architectures. Server configurations may, for instance, involve any combination of e.g., web servers, database servers, email servers, web proxy servers, DNS servers, FTP servers, file servers, DHCP servers, to name a few.

In some examples, the memory unit may be integrated with or internal to the control unit. The memory unit may store program instructions for execution by the control unit, as well as temporary and permanent data used by the control unit. Program instructions and/or temporary and permanent data pertain to the in-line thread stitch coloring data as well as other data used by the control unit to generate said in-line thread stitch coloring data. The stored in-line thread stitch coloring data may be used for coloring a thread either directly (with at least some expected delay as is readily understood by the person skilled in the arts of computer networking), or at a later stage.

It should be noted that the components described above may not necessarily be included in the stand-alone treatment unit 100. In other examples the components of the treatment unit 100 are separated into several units, where at least one unit thereof is a stand-alone unit. Preferably, the stand-alone unit at least includes the at least one discharge device 150.

The control unit 109 could be part of the system 10, the treatment unit 100, the thread consuming device 15 or be an external control unit.

As illustrated in FIG. 3, the control unit 109 may be in communication with a further control unit 110. The control unit 110 may be configured to generate thread stitch coloring data for the in-line coloring process, as will be described in more detail with reference to FIG. 7. The above technical description relating to the first control unit 109 is applicable also to the second control unit 110 (such as for example communication techniques, memory, processors 112, It should further be noted that the first and second control unit 109, 110 could be one single control unit. Hence, the separate controller and the control unit 110 may be configured in tandem to operate according to aspects and related examples, of the present disclosure.

Figure 4:
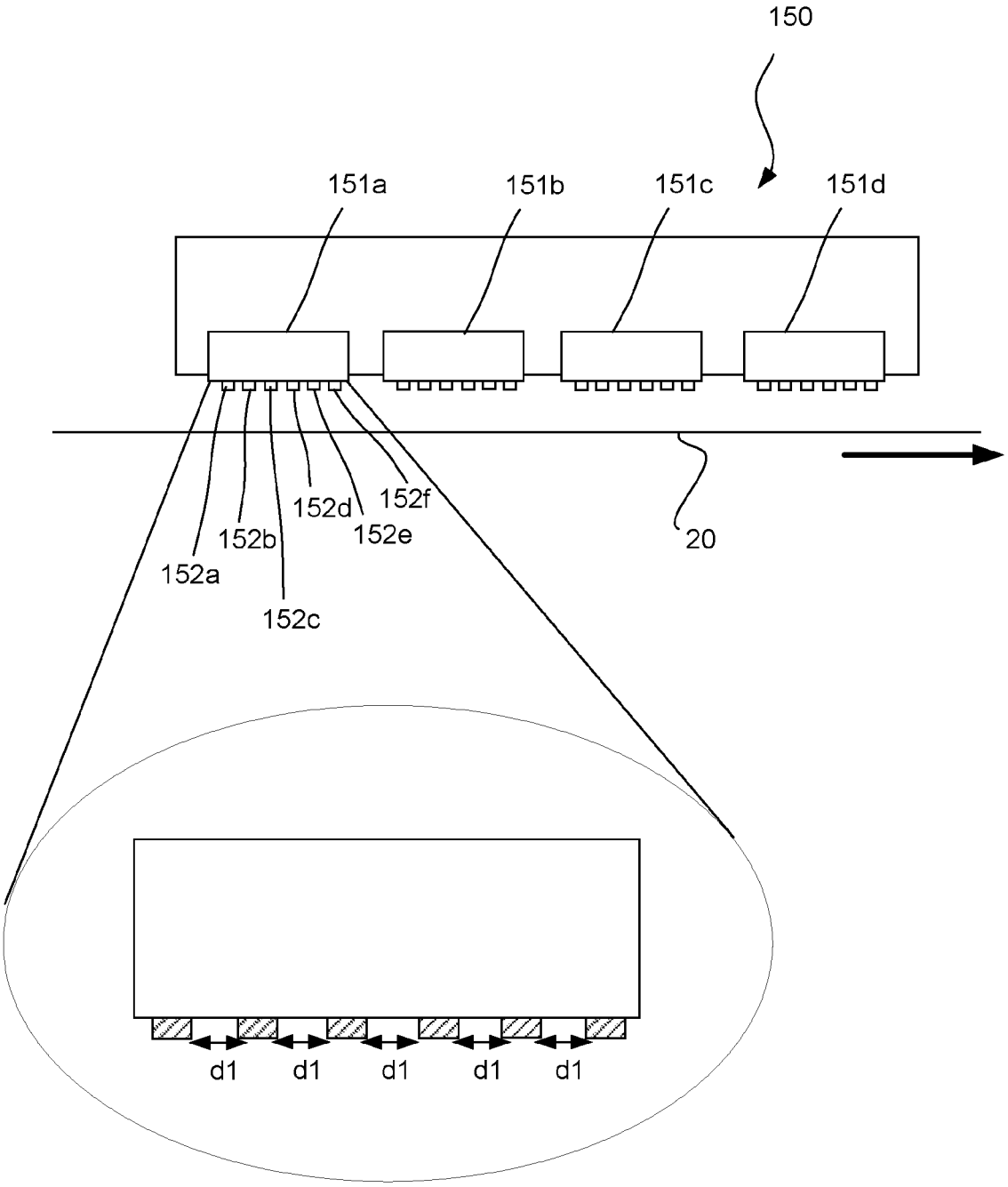
FIG. 4 is a schematic view of a discharge device forming part of a treatment unit according to one example.

FIG. 4 shows a discharge device 150 according to one example. The discharge device 150 forms part of the treatment unit 100 as described above. The direction of movement of the thread 20 in use is indicated by the bold arrow of FIG. 4, i.e., longitudinally. The discharge device 150 comprises a plurality of nozzles 152*a-f* arranged at different longitudinal positions (for example spaced by a distance d1) along the thread 20 which passes by the treatment unit 100 during use. Each nozzle 152*a-f* is arranged to dispense a coating substance, such as ink, onto the thread 20 when the nozzle is activated. The coating substance is absorbed by the thread 20 at different circumferential positions of the thread 20 when the thread 20 twists about its longitudinal axis. The relative position of two adjacently dispensed droplets of coating substance may be selected such that the droplets will overlap.

The treatment unit 100 comprises one or more discharge devices 150. Each discharge device 150 is preferably formed as a series of ink-jet print heads 151*a-d*, each print head 151*a-d* having one or more nozzle arrays. Each nozzle array typically comprises hundreds or thousands of nozzles. For illustrative purpose only six nozzles 152*a-f* are shown for one print head 151*a-d*; it should however be realized that each nozzle array may be provided with hundreds or thousands of nozzles 152 each. As an example, each print head 151*a-d* may be associated with a single color; in the shown example, the discharge device 150 has four print heads 151*a-d*, each print head 151*a-d* being associated with a specific color according to the CMYK standard. However, other coloring models may be used as well.

The exact configuration of the discharge device 150 arranged in the treatment unit 100 may vary. For example, the treatment unit 100 may be provided with a single discharge device 150 having a plurality of print heads 151*a-d*. Each print head 151*a-d* may in turn be provided with a plurality of nozzles 152*a-f*.

In some examples the treatment unit 100 is provided with several discharge devices 150, arranged either in series or in parallel. Each discharge device 150 is then provided with a plurality of print heads 151*a-d*. If serially arranged, the upstream discharge device 150 may have print heads 151*a-d* being associated with one or more colors of a specific color standard, while the downstream discharge device 150 has print heads 151*a-d* being associated with other colors of the same color standard. If arranged in parallel, each discharge device 150 may have print heads 151*a-d* being associated with all colors of a specific color standard, but with different threads 20. For such examples, two separate threads 20 can be treated simultaneously and in parallel. Combinations of parallel/serial configurations are of course also possible.

In a yet some examples, the discharge device 150 is only having a single print head 151*a-d*. Dynamic coloring of the thread 20 would then require several discharge devices 150 of the treatment unit 100.

Each nozzle 152*a-f* may dispense a coating substance having a color according to the CMYK color model, where the primary colors are Cyan, Magenta, Yellow, and Black. It may thus be possible to dispense a wide variety of colors onto the thread by activating nozzles 152*a-f* such that the total coloring substance of a specific length of the thread 20 will be a mix of the coloring substances dispensed by the nozzles 152*a-f*. As explained earlier, this is preferably achieved by having several print heads 151*a-d* arranged in series, whereby the nozzles 152*a-f* of a specific print head 151*a-d* are dedicated to a single color. In some examples, each nozzle 152*a-f-f* dispenses a coating substance having a color comprising a mix of two or more primary colors of the CMYK color model. It should be noted that the nozzles could be arranged to dispense different kinds of coating substances, not only color coatings.

The control unit 109 is configured to control the activation of the nozzles 152*a-f* such as the coating substance is emitted onto the thread 20 as it passes through the treatment unit 100, and especially pass the discharge device 150. By such configuration very precise coloring of the thread 20 is possible e.g., in order to provide advanced embroidery patterns, visually extremely sophisticated by means of the coloring provided by the treatment unit 100. For a coloring operation the control unit 109 receives one or more input signals specifying the desired color and/or coloring effect. The color input preferably includes information regarding the exact color, as well as the longitudinal start and stop positions of the thread 20 for that particular color. The longitudinal start and stop position could be represented by specific time values if the thread speed is determined.

The coloring operation may generate different visual effects on the thread. Visual effects may e.g., include a gradient, stripes, mottling, etc. More specifically, typical effects which are used include i) color change in respect to absolute thread length (such as 3 cm red, 23 cm green), ii) color change in respect to relative thread length (such as 30% red, 70% green), iii) solid color, iv) gradient, v) noise, vi) manipulation (such as change in hue, tone, brightness, contrast, etc.), vii) mix (i.e. merging of different swatches). Each one of these effects can be repeated for a number of times within the area of the certain effect. Within this context, the term "noise" relates to one or more colors to which some kind of manipulation is added, e.g., saturation or brightness, where the manipulation is a fractal, Gaussian, or other. The term "swatch" relates to a setting that will generate a specific dispensing pattern, of the coating substance, for a certain design segment. The design segment may be a part of a pattern, figure, shape, text, emblem, symbol, color gradient, or the like. A swatch may e.g., be a solid, a gradient, or a transformation from a solid which after a certain length transforms to a gradient between two colors.

Figure 5:
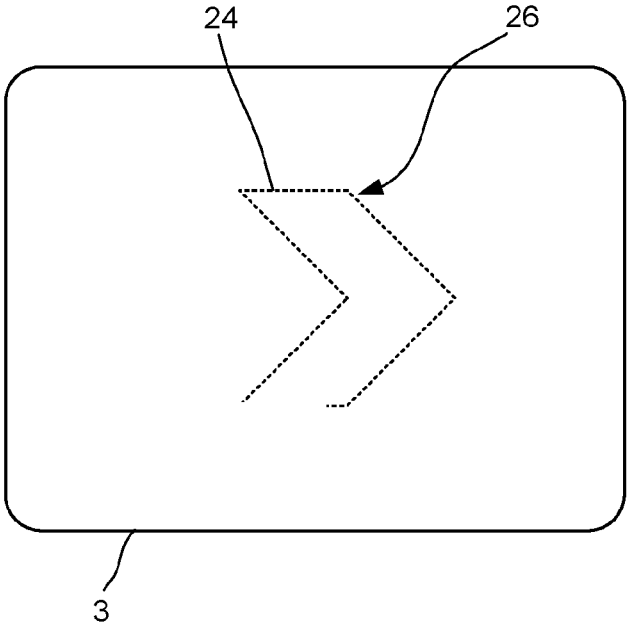
FIG. 5 is a schematic illustration of a thread being applied to a substrate according to one example.

With further reference to the example of FIG. 5, the thread consuming device 15 is arranged to provide a thread arrangement into a substrate 3 using the colored thread. The thread 20 is applied to the substrate 3 by a plurality of consecutive thread portions 24. The thread arrangement corresponds to a decorative thread pattern to be produced, such as an embroidered object 26. Hence, a plurality of thread portions 24 form an object 26 as a decorative thread pattern onto the substrate 3. The object 26 may be a specific pattern, figure, shape, text, emblem, symbol, or the like. The object 26 may be a logotype or a company name, for example in the form of an embroidery.

The thread portions may be a stich. In this context, a stitch may for example be a single turn of thread, a single loop of thread, a single turn of yarn or a single loop of yarn. Stitches may for example be applied using sewing, knitting, embroidery, crochet and/or needle lace-making.

Depending on particular details of the thread consuming device 15, the thread arrangement may be a stitch pattern (such as in the case of an embroidery machine, a knitting machine, or a sewing machine), a weave pattern (such as in the case of a weaving machine), or a tuft pattern (such as in the case of a tufting machine).

In embroidery, a stitch can for example be seen as a running stitch that pass through the fabric in a simple up and down motion, a back stitch that pass through the fabric in an encircling motion, a chain stitch that catch a loop of the thread on the surface of the fabric, a knotted stitch that is formed by wrapping the thread around the needle. A stitch may be formed by generating two insertion points into the substrate 30.

In knitting, a stitch can be seen as single loop of yarn, secured to the loops beside it to form a row or course of stitches and to the loops above and below it to form a wale. In securing the previous stitch in a wale, the next stitch can pass through the previous loop either from below or above. In crochet, a stitch can be seen as being made by pulling a loop of thread through the previous stitches. Although specific types of stitches have been mentioned, it should be noted that all kinds of stitches can be used for the system disclosed herein.

Figure 6:
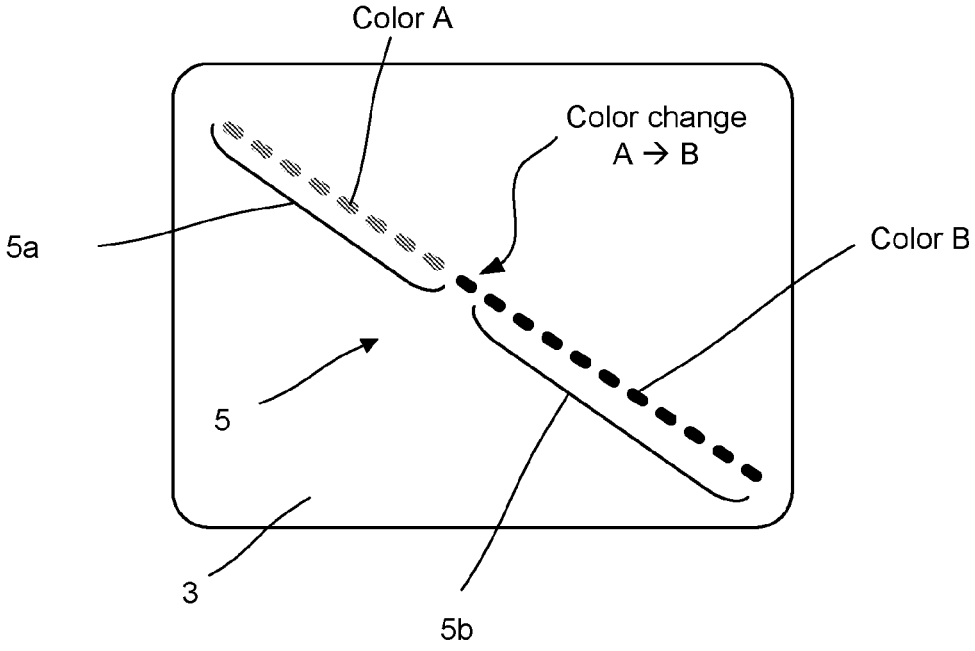
FIG. 6 is a schematic illustration of a color transition of a thread being applied to a substrate according to one example.

FIG. 6 shows a decorative thread pattern 5 having two different color portions 5*a*, 5*b* according to one example. In this example, the thread portion 5*a* is arranged with color A and the thread portion 5*b* is arranged with color B. When producing a decorative thread pattern comprising a plurality of different colors on a substrate, it is important that the color transition is correctly determined. Hence, the color change from color A to color B needs to be precisely controlled. The inventors have realized a novel way of creating precise color transitions and to convert different pattern data to account for these specific color changes. Generally, this is achieved by adding extra thread portions that handles the color transitions. In order to provide a decorative object on the substrate which appears aesthetically pleasing, it is beneficial if the color transitions are precise and that additional thread portions (such as stiches) that account for the color change are hidden from the final object. This can be achieved in at least two different ways. The first option is by adding the additional thread portions as underlay thread portions that are not visually shown in the finished object. The second option is by adding the additional thread portions on a residual substrate that does not form part of the object. Either one of these options may be realized, singly or in combination.

In the following examples of the present disclosure, the thread portions may therefore be stitches, and the residual stiches may be one or more of 1) stitches on a residual fabric, or 2) underlay stitches. The residual fabric is not intended to be produced with a decorative thread pattern that is part of the finished product. The fabric can be seen as a residual fabric, a waste fabric or the like. The fabric is configured to receive at least one unwanted or residual stich that accounts for the color change. Accordingly, it is possible to control the color change of the thread on a substrate that is not to be part of the finished product. Concerning residual stitches being envisaged as underlay stitches, these are arranged on an opposite side of the decorative pattern being produced such that they are not visually distinguishable by a person looking at said decorative pattern from his point of view. To this end, the underlay stitches are not necessarily arranged at an opposing side of the substrate from the side where the decorative pattern is produced, per se, but rather an opposing side of the decorative pattern itself.

Figure 7:
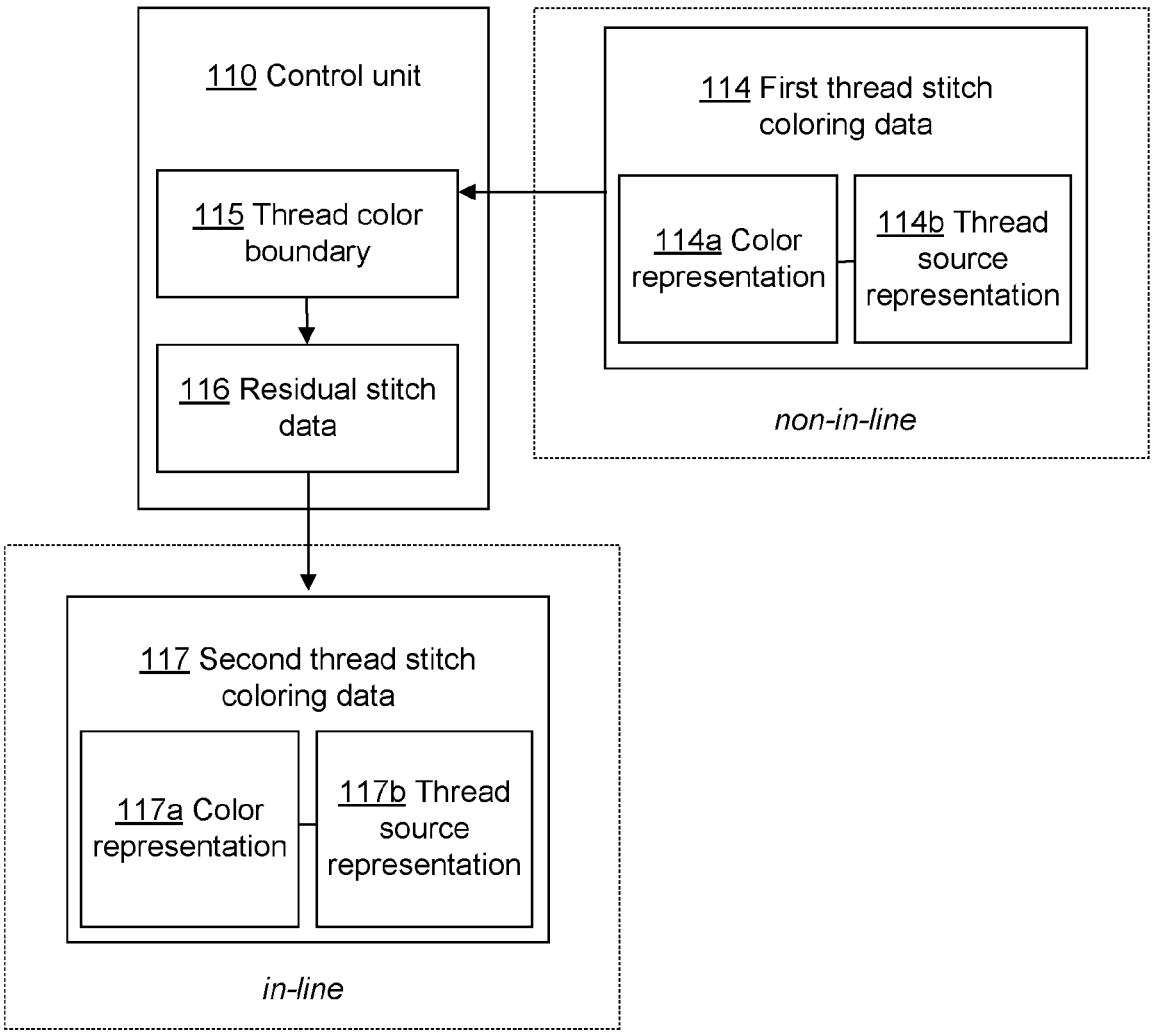
FIG. 7 is a schematic illustration of converting first thread stitch coloring data into second thread stitch coloring data according to one example.

FIG. 7 shows exemplary inputs and outputs to and from the control unit 110 as defined herein. The control unit 110 is configured to receive, process and transmit said inputs and outputs for purposes of converting first thread stitch coloring data 114 into second thread stitch coloring data 117. The first thread stitch coloring data 114 is to be understood as data applicable for traditional (non-in-line) systems while the second thread stitch coloring data 117 is to be understood as data applicable for in-line systems, as indicated in FIG. 7. To this end, the control unit 110 is configured to enable in-line systems to process thread stitch coloring data originally constructed for use in non-in-line systems.

The first thread stitch coloring data 114 comprises a set of color representations 114*a* and a corresponding set of thread source representations 114*b*. In non-in-line processes one color is typically associated with a respective thread source. Therefore, in the representations thereof a particular color representation 114*a* is assigned to a particular thread source representation 114*b*, thus forming a 1-1 relationship. Any suitable data structure may be used for storing said assignment of color representations to thread source representations, such as a hash map, array, tuple, set, graph, and the like.

The control unit 110 is configured to obtain the first thread stitch coloring data 114. The first thread stitch coloring data 114 may be obtained from a user interface, such as the display 195 explained with reference to FIG. 3, or alternatively from an external device such as a mobile phone, tablet, laptop computer, to name a few examples.

The control unit 110 is configured to obtain at least one thread color boundary 115 from the first thread stitch coloring data 114. The thread color boundary defines a color change from a first color to a second color among the set of color representations 114*a*. By way of obtaining the thread color boundary from the first thread stitch coloring data 114, the control unit 110 may recognize where one or more color transitions take place in the digital representation. Generally, color changes may be a result of one or more of a color transition in the digital representation which the first thread stitch coloring data is based on, a cutting process of a thread, a relative movement of a substrate, and a combination thereof.

Recognizing where said one or more color transitions take place may involve, by the control unit 110, obtaining pattern data from the first thread stitch coloring data 114. Pattern data comprises information related to pixels in the digital representation. Accordingly, the pattern data comprises a plurality of pixels, wherein each pixel is associated with a position in the digital image and a color value. In the example where the digital representation is a digital image, the pattern data may be seen as the image data. Since the digital representation is typically two-dimensional, the position is indicative of a two-dimensional position. As an example, a pixel located at a top left corner of the digital image may have a position 0, 0, and a pixel located at the bottom right corner of the digital image may have a position $row_{max}$, $col_{max}$, wherein $row_{max}$ is the maximum number of pixel rows in the digital image and $col_{max}$ is the maximum number of pixel columns in the digital image. In this example, if the resolution of the digital representation is 1080p (1920×1080), the pixel located at the bottom right corner of the digital image has the position 1080, 1920. Similar pixel positions can be realized for other image resolutions, e.g., 2K, 4K, 8K and so forth.

The color value may pertain to any color space known in the art, e.g., the RGB or CMYK color space. Accordingly, if the color value of a pixel in the RGB color space is derived as 0, 0, 0, the color value represents the color black.

After having obtained the pattern data of the first thread stitch coloring data, the method further involves generating resolution data. Resolution data is generated by processing the pattern data of the digital representation. During this procedure, information relating to a thread arrangement comprising a plurality of consecutive thread portions of the pattern to be created/produced is determined. The processing of the pattern data may comprise determining information relating to the length of the thread portions, the direction of the thread portions, and/or the type of connections used for consecutive thread portions.

The control unit 110 is further configured to determine residual stitch data 116 based on the (at least one) thread color boundary 115. The residual stitch data indicates a number of residual stitches required in order to carry out the color change in an in-line thread coloring process. The residual stitch data may be determined differently depending on how the residual stitches are to be carried out in a future in-line thread coloring process, as will be discussed later on in this disclosure.

The residual stitch data may comprise information of one or more of a length of a color change, a direction of residual stitches used in carrying out said color change, a substrate property where the color change is to be carried out, a thread property of a thread to be used for carrying out the color change, and a combination thereof. The residual stitch data may comprise information relating to a type of residual stitch to be used. The type of residual stitch relate to whether underlay stitches or residual stitches are to be used. This information may be determined automatically by the control unit 110, for instance based on the other data of the residual stitch data. For instance, if the residual stitch data indicate that a length of a color change is 5 cm, a direction of residual stitches is in the longitudinal direction of the substrate, the substrate is of a particular material, e.g., linen, and a certain thread is used, e.g., polyester fibres, the control unit 110 may be configured to, based on this information, automatically set a type of residual stitch to underlay stitches or the residual stitches on a residual substrate. This selection may thus depend on respective suitability of the different type of information of the residual stitch data. In alternative examples the type of residual stitch may be selected by a user.

The control unit 110 is configured to generate the second thread stitch coloring data 117 based on the residual stitch data 116 such that the color change of the first thread stitch coloring data 114 is accounted for in the in-line thread coloring process. In contexts of the present disclosure, the term "accounted for" typically corresponds to a future usage of the second thread stitch coloring data 117 requiring additional stitches compared to a usage of the first thread stitch coloring data 114. This is due to the fact that a color change in an in-line process is not as intuitive as the corresponding color change in a non-in-line process. In in-line processes, there is typically some intermediary colors in between the first and the second colors due to the (re)coloring of the thread from the first to the second color. Conversely, in non-in-line processes the color change would happen immediately as a response to a switch between a first thread source to a second thread source, the respective thread sources storing thread of different colors. Such switches are typically carried out by cutting the thread exactly at the position where the thread color boundary is due. This is, however, not possible for in-line processes as there is inevitably envisaged one or more additional stitches to account for the (re)coloring of the thread. In addition, for in-line processes, it can sometimes be difficult to predict exactly where the thread color boundary is due.

In view of the above, the second thread stitch coloring data 117 is adapted to be processed by a system for in-line thread coloring, such as the system 10 previously described. The conversion may be carried out in the same system as the system obtaining the first thread stitch coloring data 114, or another system. It is thus envisaged that the second thread stitch coloring data 117 may be received by another system for subsequent production of the decorative pattern. It is also envisaged that the second thread stitch coloring data 117 may be consumed by the same system after it has been generated based on the first thread stitch coloring data. This is thanks to the second thread stitch coloring data 117 being packaged in a file suitable to be transmitted to other in-line thread coloring systems.

The first and second thread stitch coloring data 114, 117 may be managed in a corresponding file, such as an embroidery file. Since the embroidery file includes information pertaining to a digital representation that is to be produced as a decorative thread pattern, the embroidery file may be managed in a bitmap graphics format including but not being limited to GIF, JPEG, PNG, TIFF, XBM, BMP, PCX, and the like. The digital representation may alternatively be virtually rendered by the control unit or some other type of device capable of rendering digital content.

In following examples of the disclosure, various ways of determining the residual stitch data will be defined. Although these examples refer to physical components such as a frame, it shall be understood that the determination of the residual stitch data is carried out by the control unit 110 before the actual decorative pattern has been produced. The illustrative drawings are merely provided for explanatory purposes, and shall be understood to convey the meaning of what is to occur once the second thread stitch coloring data is used in an in-line thread coloring process, based on previously determined residual stitch data adhering to the thread color boundary obtained from the first thread stitch coloring data.

FIGS. 8A-D show different examples of determining residual stitch data. In these examples, the residual stitch data is determined by estimating a number of residual stitches adapted to be carried out on a residual substrate 3*b* different from a substrate 3*a* where the decorative thread pattern is to be produced. Once a color transition is to be made from first color to a second color, a predefined number of stitches closest to the initiation of the color transition will be made on the residual fabric 3*b* instead of the fabric 3*a* that forms the finished product (i.e., the fabric 3*a* that is to be produced with a decorative thread pattern). Hence, stiches 6*a* being associated with the first color will be made on the fabric 3*b* until the color transition from color A to B occurs, when the stiches 6*b* from the second color will be made. Once a thread color boundary range has been reached, the stiches will be performed on the fabric 3*a*. The boundary range may depend on the number of stiches, the amount of thread consumed and/or a combination of the two parameters. These values are typically stored as parts of the residual stitch data.

In order to allow for visual effects of the decorative thread pattern to be produced, the control unit 110 is configured to determine an object to be produced as a decorative thread pattern. From this object, which e.g., may be a graphical representation of an item, an image, a logotype, etc., the control unit 110 is further configured to determine a thread arrangement comprising a plurality of consecutive thread portions, each thread portion having a thread portion direction, wherein the entire thread arrangement corresponds to said object to be produced. The control unit 110 may be configured to receive thread arrangement data from another control unit. For instance, the thread consuming device 15 may be provided by a first supplier, while the treatment unit 100 is provided by a second supplier. In such case the control unit 110 may be provided with the treatment unit 100, while being configured to receive thread arrangement data from a control unit 110 of the thread consuming device 15.

In these examples a frame 30 is employed. The frame 30 is arranged to hold a substrate 3 having two sections 3*a*, 3*b*. In these examples the substrate 3 is a fabric 3. The embroidery frame 30 comprises a main frame 32 and at least one sub-frame 34. The main frame 32 is configured to receive the fabric 3*a* that is to be produced with a decorative thread pattern. The sub-frame 34 is configured to receive a fabric 3*b* that is not intended to be produced with a decorative thread pattern, i.e., the residual fabric 3*b*. The embroidery frame 30 comprises four sides 31*a-d*, two longitudinal sides 31*a*, 31*b* and two transverse sides 31*c*, 31*d*. The longitudinal sides are of a length H3 and the transverse sides are of a length L3. The sub-frame 34 is preferably smaller in size than the main frame 32. This is preferred as the main frame 32 is the frame configured to hold the fabric 3*a* that is to be produced with a decorative thread pattern.

Figure 8A:
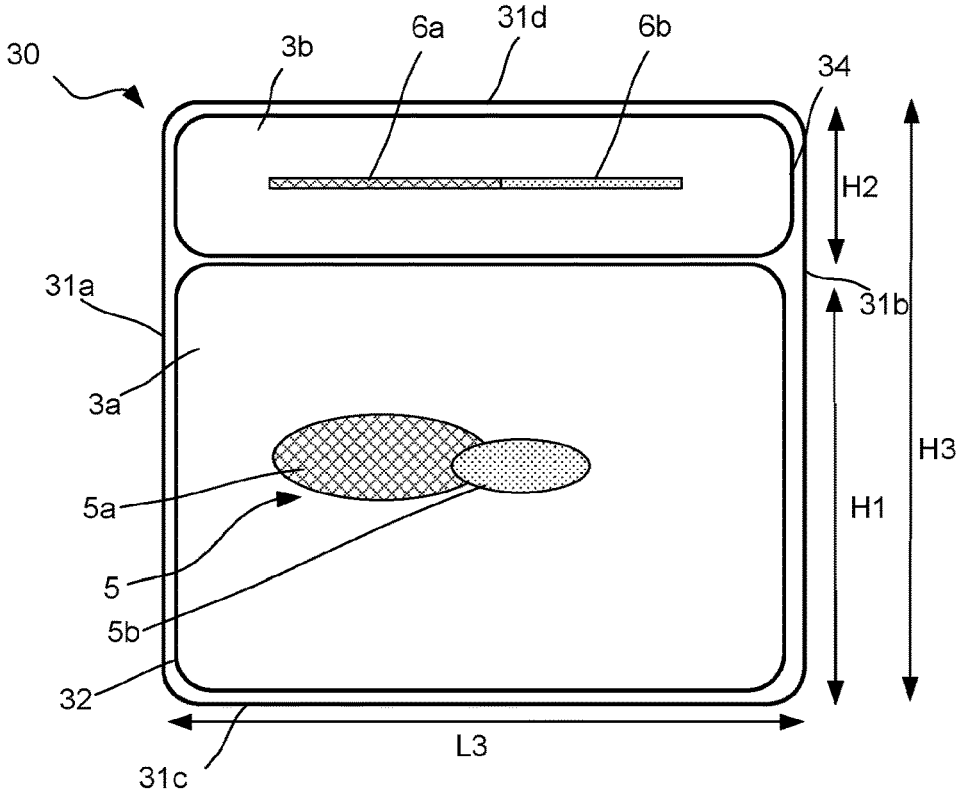
FIGS. 8A-D are schematic top views of an embroidery frame according to different examples.

In the example of FIG. 8A, the length of H3 is larger than the length of L3. However, as should be understood, the L3 could be equal to H3, or the length of L3 could be larger than the length of H3. Moreover, the frame 30 could have a different shape, for example rounded. The sub-frame 34 is arranged above the main frame 32. However, it should be understood that the sub-frame 34 could have different placements in relation to the main frame 34, as further exemplified by the examples of FIGS. 8B-D.

Figure 8B:
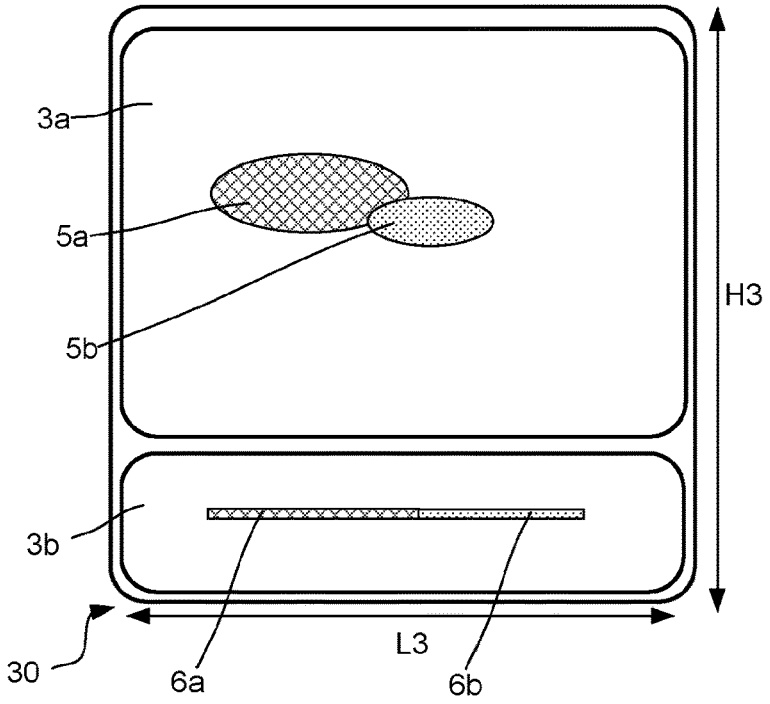

In the example of FIG. 8B, the sub-frame 34 is arranged below the main frame 32.

Figure 8C:
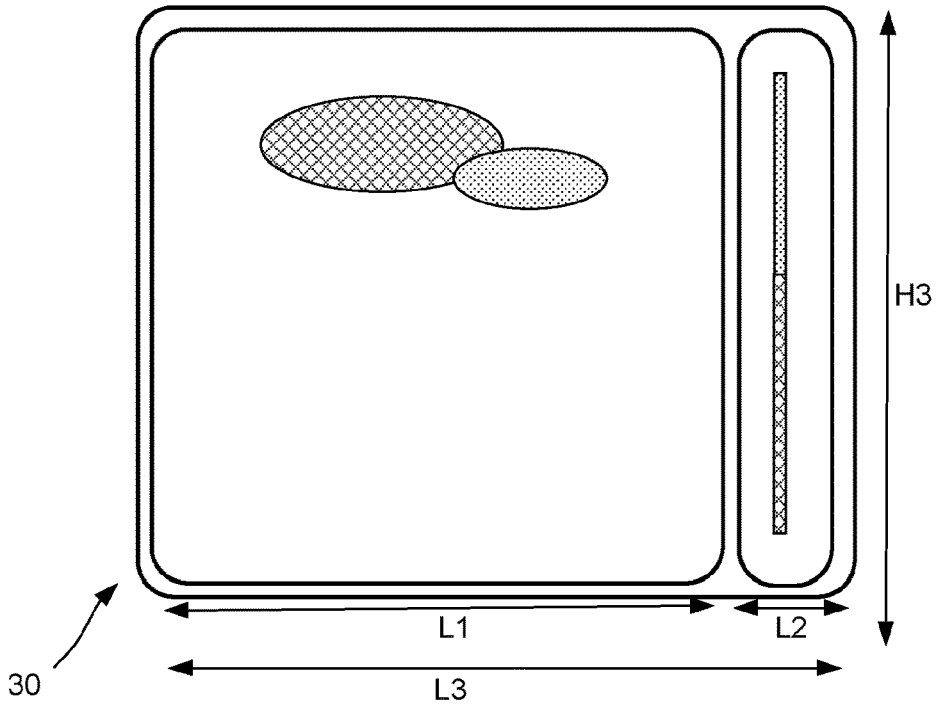

In the example of FIG. 8C, the sub frame 32 is arranged along a longitudinal side of the main frame 32.

Figure 8D:
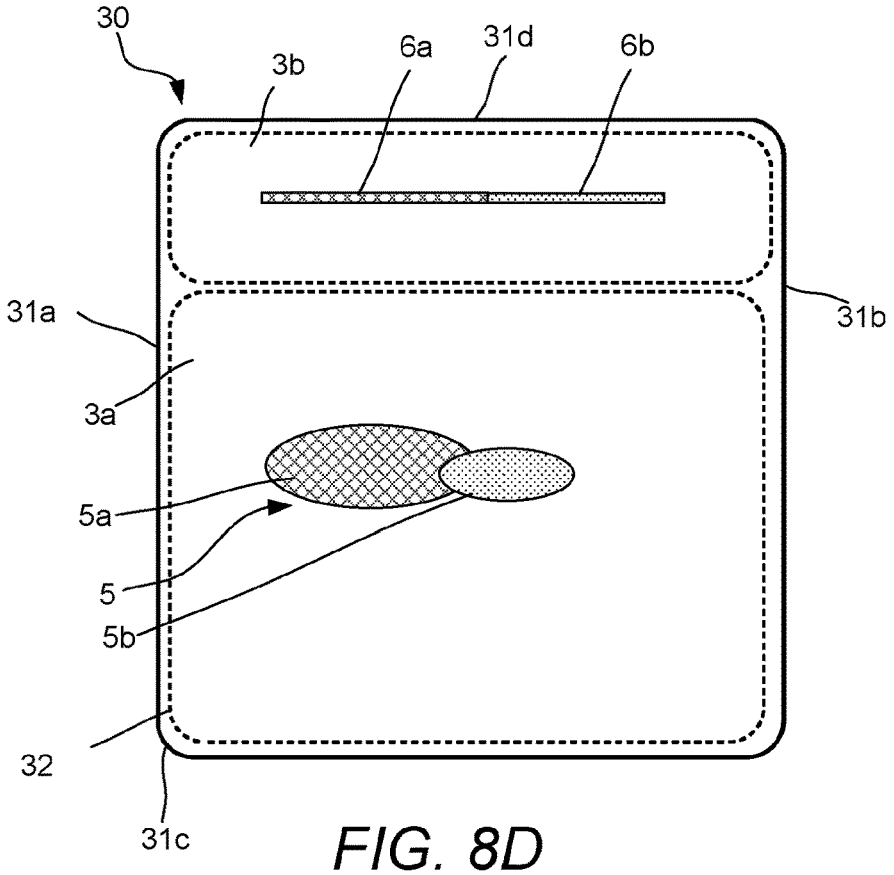

In the example of FIG. 8D, the sub-frame 34 has the same length L3 as the main frame 32 and the height H2 of the sub-frame 34 is smaller than then the height H1 of the main frame 32. The frame 30 only consist of a main frame 32. Hence, no sub-frame 34 is present. However, the main frame 32 comprises two different fabrics, the fabric 3*a* that is to be produced with a decorative thread pattern and the fabric 3*b* that is configured to receive at least one unwanted/residual stich. A similar example is shown in FIG. 9, where the frame is has a substantially circular shape.

The relationships between the dimensions of the sub-frame 34 and the main frame 32 may be altered. Hence, the frame 30 has a fixed dimension, whereas the dimensions of the sub-frame 34 and the main frame 32 are adaptable. This adaptation in size could for example be realized by making the main frame and the sub-frame slidable in relation to each other. Alternatively, the main frame 32 and the sub-frame 34 have fixed dimensions.

As previously stated, the frame 30 may be arranged on a movable stage 2*b*. The frame 30 can thus be moved in relation to the at least one needle of the thread consuming device 15. The movement of the movable stage 2*b* may be performed based on instructions from the thread consuming device 15, the treatment unit 100 and/or from a control unit 110.

Figure 9:
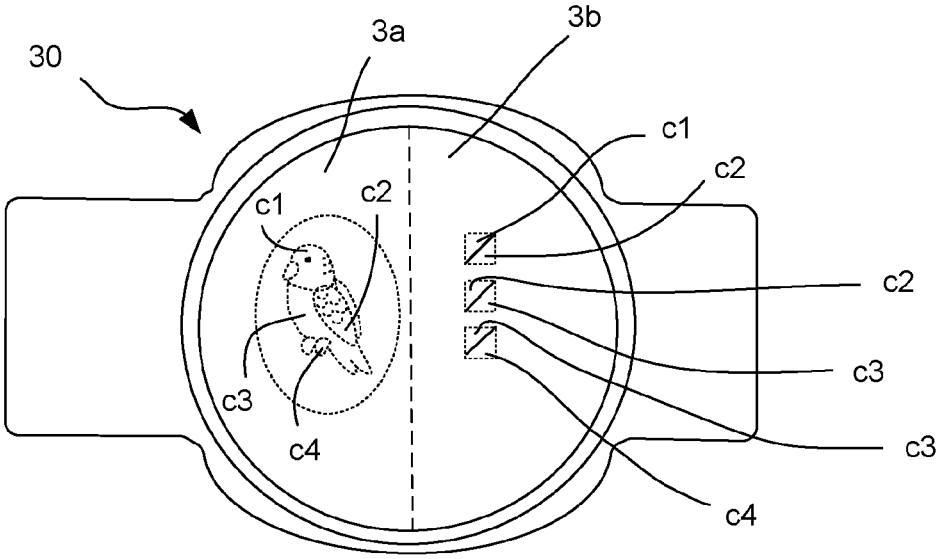
FIG. 9 is a schematic top view of an embroidery frame according to one example.

FIG. 9 shows yet another example of determining residual stitch data. Similar to the examples of FIGS. 8A-D, the residual stitch data is determined by estimating a number of residual stitches adapted to be carried out on a residual substrate 3*b* different from a substrate 3*a* where the decorative thread pattern is to be produced. Moreover, the frame 30 is rounded in this example. In this example, the decorative thread pattern is of a parakeet having four colors c1, c2, c3, c4.

The stitching order is in this example determined to start with a first color c1 corresponding to the color of the head of the parakeet, proceed to a second color c2 corresponding to the color of the wings of the parakeet, proceed to a third color c3 corresponding to the color of the body of the parakeet, and finish with a fourth color c4 corresponding to the color of the feet of the parakeet. The residual stitch data has been determined by identifying three color changes: c1 to c2, c2 to c3, and c3 to c4. For each color change, a number of residual stitches have been estimated. To this end, the parakeet will be produced according to the following steps: (i) coloring the thread with the first color c1 and stitching the head of the parakeet on the substrate 3*a* using said thread colored with the first color c1; (ii) identifying an upcoming color switch, thereby initiating residual stitching on the residual substrate 3*b* at a first stitch patch using the thread colored with the first color c1 while initiating (re)coloring of the thread into the second color c2; (iii) identifying that the color switch is completed, thereby initiating stitching of the wings of the parakeet on the substrate 3*a* using said thread colored with the second color c2; (iv) identifying an upcoming color switch, thereby initiating residual stitching on the residual substrate 3*b* at a second stitch patch using the thread colored with the second color c2 while initiating (re)coloring of the thread into the third color c3; (v) identifying that the color switch is completed, thereby initiating stitching of the body of the parakeet on the substrate 3*a* using said thread colored with the third color c3; (vi) identifying an upcoming color switch, thereby initiating residual stitching on the residual substrate 3*b* at a third stitch patch using the thread colored with the third color c3 while initiating (re)coloring of the thread into the fourth color c4; and (vii) identifying that the color switch is completed, thereby finalizing stitching of the parakeet by stitching the feet thereof on the substrate 3*a* using said thread colored with the fourth color c4.

In the example above and in other examples where identification of color switches are carried out, various different methods known in the art may be employed for these purposes. For instance, color identification may be carried out using an illuminator device configured to illuminate an area where the thread is located, and an image sensor, such as a camera, configured to capture an image of the illuminated thread. Thereafter, one or more image processing techniques may be employed using e.g., color analysis or color segmentation for determining color data of the thread. The color data may be compared to expected color data, thereby outputting a determination whether a color change has been carried out or not. The illuminator device and image sensor may be arranged at a suitable location in the system 10, and the control unit 110 may be configured to control the operations thereof, as well as perform suitable image processing techniques.

Figure 10A:
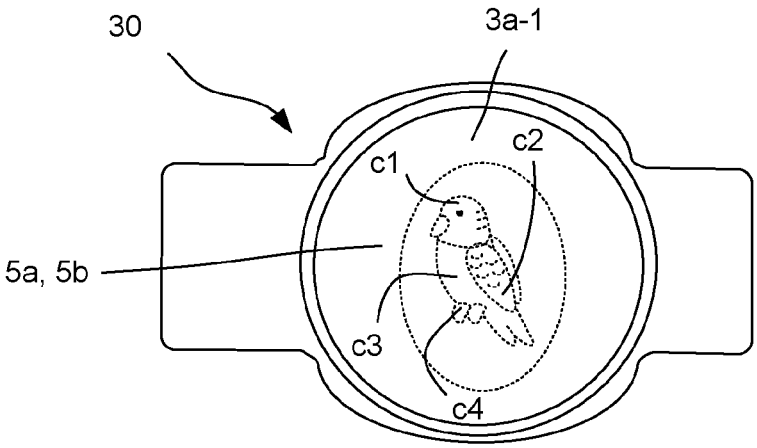
FIGS. 10A-B are schematic top views of an embroidery frame according to one example, FIG. 10A showing a first side of a substrate and FIG. 10B a second opposite side of the substrate of FIG. 10A.
Figure 10B:
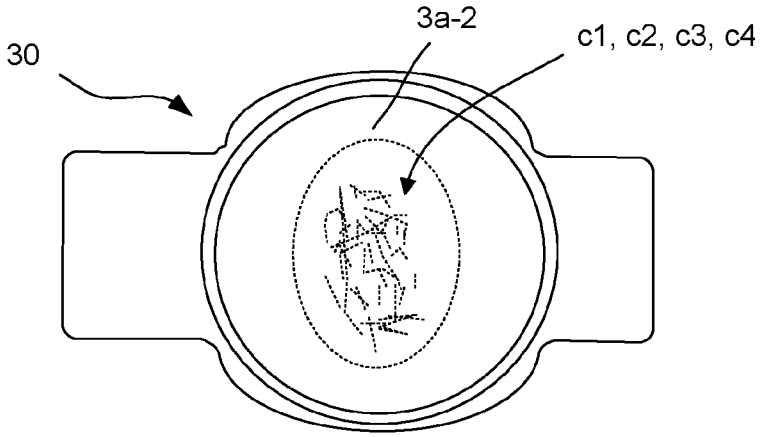

FIGS. 10A-B show another example of determining residual stitch data. In this example the residual stitch data is determined by estimating a number of residual stitches adapted to be carried out as underlay stitches on a substrate where the decorative thread pattern is to be produced.

FIG. 10A shows a first side 3*a*-1 of the substrate 3 arranged in the frame 30 where the parakeet is to be produced. Instead of having a residual substrate as were the case in the example of FIG. 9, the underlay stitches are determined to be made on the other side 3*a*-2 of the decorative pattern. This is shown in FIG. 10B. Hence, the residual stitches required in order to carry out the color switch are determined to be made at the back side of the decorative pattern to be made, typically haphazardly as is indicated by the figure.

Figure 11:
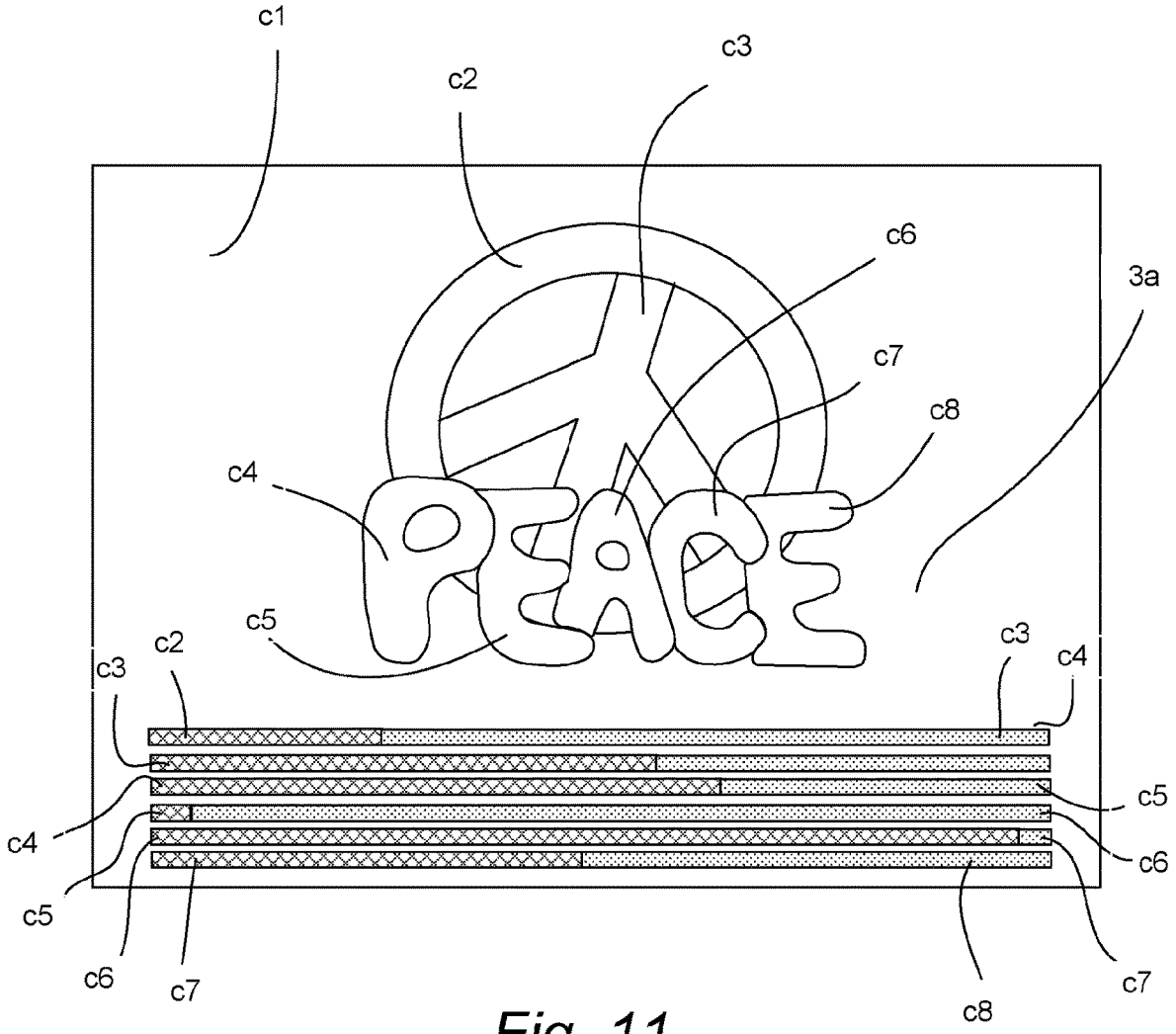
FIG. 11 is a schematic top view of a decorative pattern to be produced according to one example.

FIG. 11 is another, more advanced, example of determining residual stitch data. The procedure is carried out similarly as the steps (i) to (vii) defined with respect to FIG. 9, but instead of residual stitch patches the residual stitches are produced in a plurality of consecutive rows. The residual stitches are in this example produced at the same substrate 3*a* as where the decorative thread pattern is produced, but at a lower portion thereof. Alternatively, a different substrate could have been used as discussed herein. Instead of four different colors as were the case in the example of FIG. 9, the example of FIG. 11 uses eight different colors. However, the general approach is similarly applicable in this example with regards to identifying color changes and controlling the generation of the residual stitch data accordingly.

Regardless of what method is used for estimating the number of residual stitches, said estimation may depend on one or more operating conditions of the in-line thread coloring process. Said operating conditions may pertain to the device where the in-line thread coloring takes place, the substrate used, the thread used, and/or external conditions. Alternatively, the number of residual stitches may be set to a fixed stitch value, such as 10 stitches, or a fixed thread length value, such as 20 cm, or practically any type of other appropriate fixed value.

Figure 12:
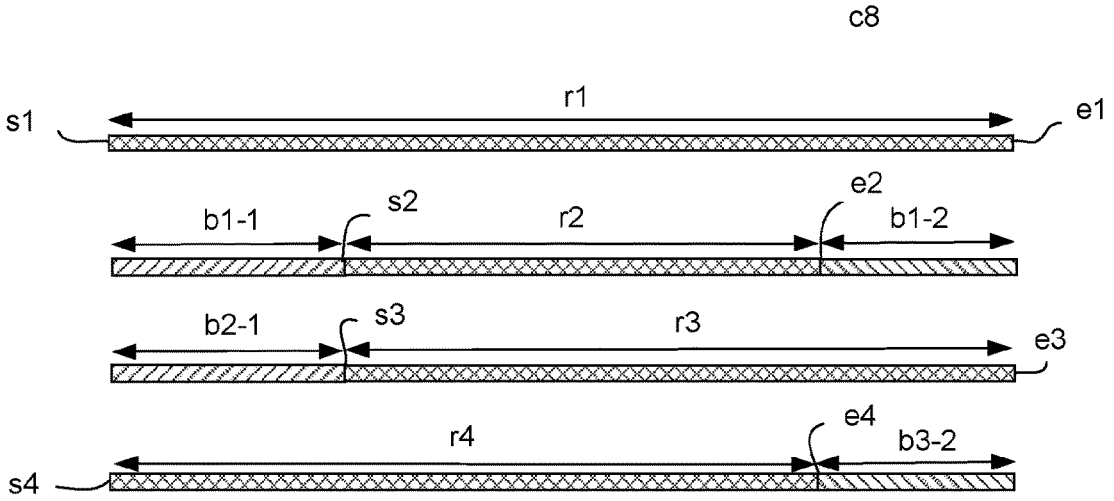
FIG. 12 is a schematic top view of determining the residual stitch data according to one example.

FIG. 12 shows various examples of determining the residual stitch data by defining different types of thread color boundary ranges r1, r2, r3, r4. In these examples the ranges are defined as rows, but other examples may also be envisaged, such as patches, circles, and the like. The thread color boundary range is not to be mixed with the thread color boundary of the first thread stitch coloring data, since it pertains to the residual stitch data which serves as a basis for generating the second thread stitch coloring data. To this end, the thread color boundary range is a range rather than a fixed boundary a required for having the time to complete the (re)coloring of the thread from a first to a second color. The thread color boundary range thus indicates a range of residual stitches having intermediary colors between the first color and the second color. The thread color boundary range has a starting value which indicates an initiation of the color change, and an end value indicating a completion of the color change. The thread color boundary range may be automatically determined by the control unit 110 based on operating conditions of the in-line thread coloring process, similar to the example above. The thread color boundary range may be altered during operation of the in-line thread coloring process. The thread color boundary range may be selected by an operator.

The first thread color boundary range r1 has a starting value s1 and an end value e1. For the second, third and fourth thread color boundary ranges r2, r3, r4, various buffers are defined. The purpose of adding buffers to the ranges is to provide additional assurance that the entire color change has been completed before returning to stitching the decorative thread pattern. The size of the buffers may vary. The number of buffers may vary. Buffers may be assigned to the starting value and/or to the end value of a thread color boundary range. Typically, a buffer added to a starting value will be associated with the first color, while a buffer added to an end value will be associated with the second color, and the range therebetween some type of combination thereof with intermediary colors between the first and second colors. Similar to the thread color boundary range, the buffers may be automatically determined by the control unit 110 based on operating conditions of the in-line thread coloring process. Moreover, the buffers may be altered during operation of the in-line thread coloring process. In addition, the buffers may be selected by an operator.

The second thread color boundary range r2 has a starting value s2 and an end value e2. Further, two buffers b1-1, b1-2 are defined, one for each one of the starting and end values s2, e2. The third thread color boundary range r3 has a starting value s3 and an end value e3. Further, one buffer b2-1 is defined for the starting value s3. The fourth thread color boundary range r4 has a starting value s4 and an end value e4. Further, one buffer b3-2 is defined for the end value e4.

Figure 13:
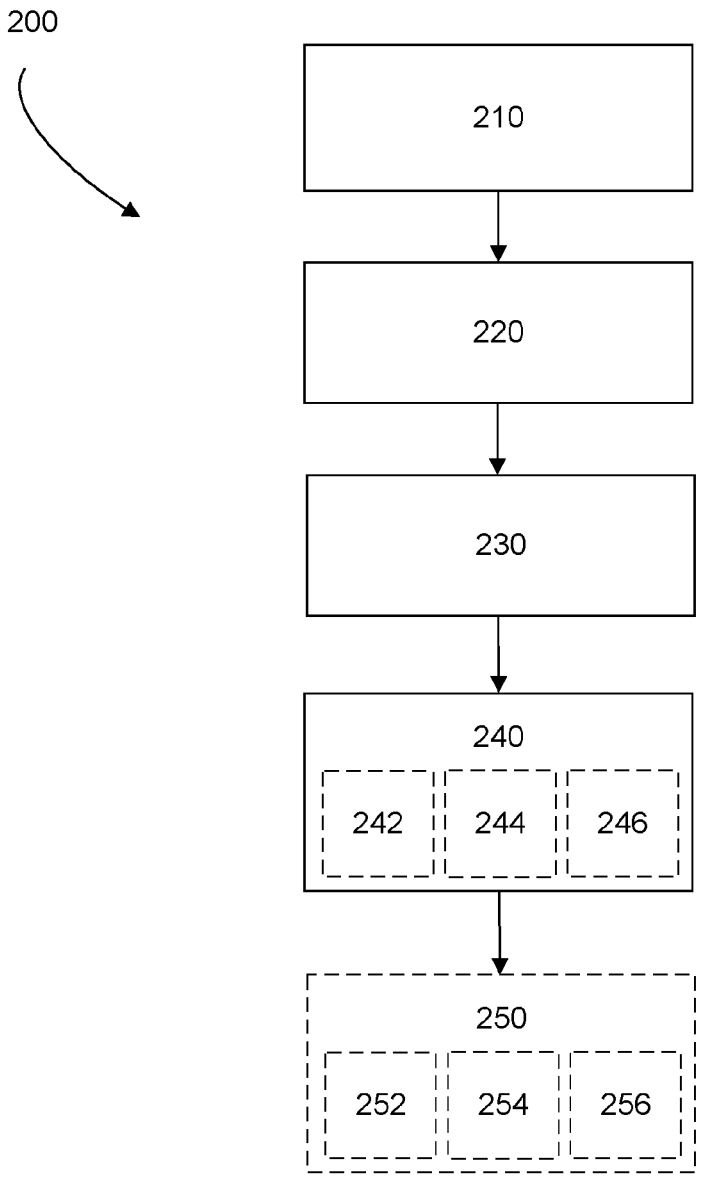
FIG. 13 is a schematic view of a method according to one example.

FIG. 13 shows an exemplary schematic diagram of a method 200 for generating thread stitch coloring data for an in-line thread coloring process. The dashed boxes of the method 200 are optional steps.

The method 200 involves a step 210 of obtaining first thread stitch coloring data based on a digital representation that is to be produced as a decorative thread pattern, the first thread stitch coloring data having a set of color representations assigned to a corresponding set of thread source representations. The method 200 involves a step 220 of obtaining at least one thread color boundary from the first thread stitch coloring data, each thread color boundary defining a color change from a first color to a second color among said set of color representations. The method 200 involves a step 230 of determining residual stitch data based on the at least one thread color boundary, the residual stitch data being indicative of a number of residual stitches required in order to carry out said color change in an in-line thread coloring process. The method 200 involves a step 240 of generating second thread stitch coloring data based on the residual stitch data such that the color change of the first thread stitch coloring data is accounted for in the in-line thread coloring process, the second thread stitch coloring data having a set of color representations assigned to a single thread source representation.

The step 240 of generating the second thread stitch coloring data may involve a step 242 of obtaining pattern data from the digital representation, the pattern data comprising a plurality of pixels, each pixel being associated with a position in the digital representation and a color value. The step 240 may further involve a step 244 of generating resolution data by processing the pattern data, wherein processing the pattern data comprises determining a thread arrangement comprising a plurality of stitches, wherein the thread arrangement corresponds to a digital representation to be produced in the in-line thread coloring process. The step 240 may further involve a step 246 of generating the second thread stitch coloring data for the thread at least based on said resolution data.

The method 200 may further involve a subsequent consumption of a thread source in said in-line thread coloring process. This may be performed based on the second thread stitch coloring data and a caused control of the in-line thread coloring process by, at step 250, controlling an in-line thread coloring process of a thread, at step 252, controlling a thread consumption process of the thread with respect to a substrate, and at step 254, controlling a residual embroidery process of the thread. The residual embroidery process may be controlled as one or both of residual stitches onto a residual substrate different from the substrate, and residual stitches as underlay stitches onto the substrate.

Figure 14:
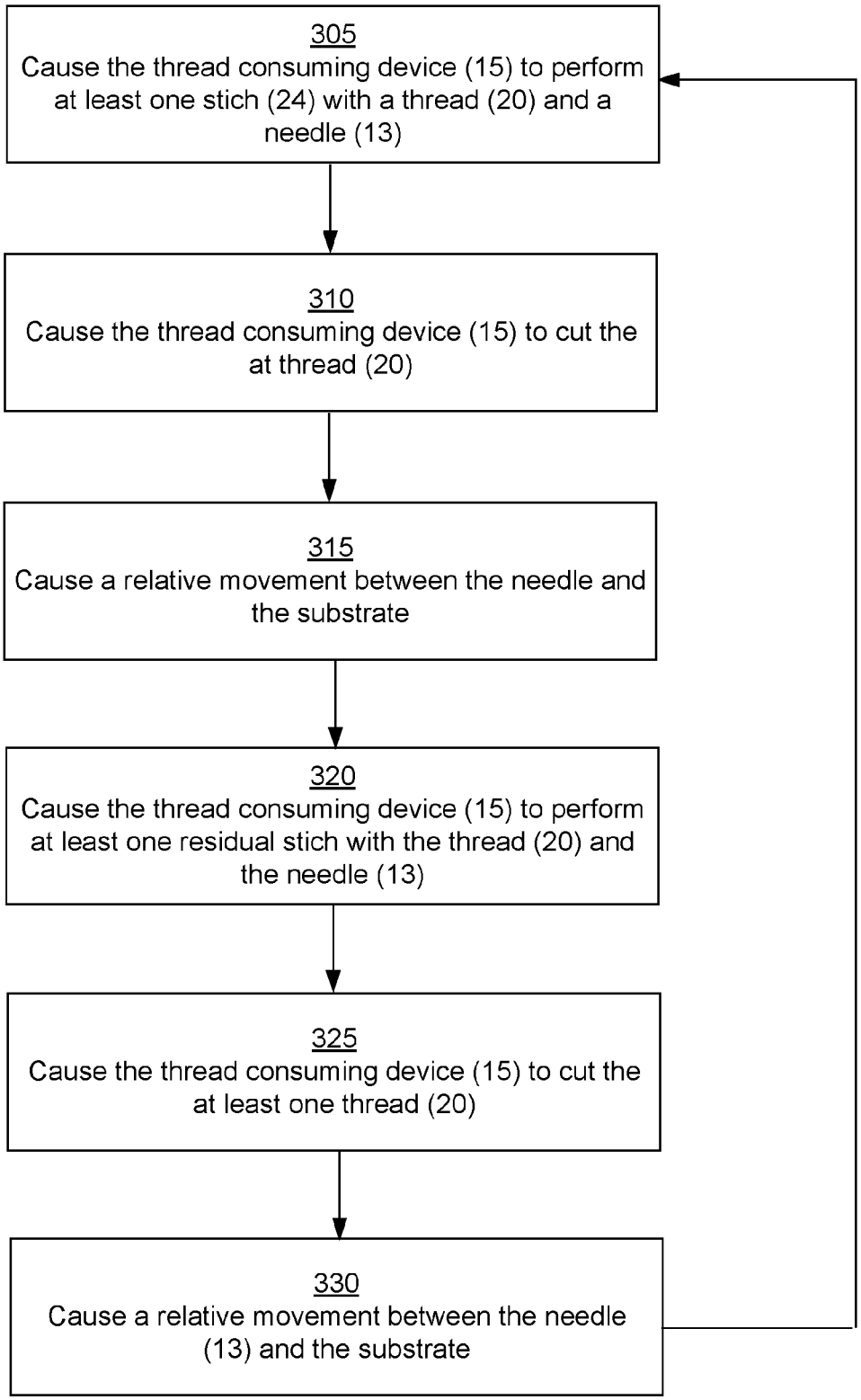
FIG. 14 is a schematic view of a method according to one example.

FIG. 14 illustrates a method 300 of a control unit 109, 110 configured to perform a method in an in-line thread coloring process. In the following example, the method is described using a frame 30 as embodied in FIG. 8A-D, however the method is applicable to the other embodiments as provided herein. The control unit 109, 110 is configured to cause 305 the thread consuming device 15 to perform a stich on the fabric 3*a* that is to be produced with a decorative thread pattern arranged in the main frame 32, and cause 310 the thread consuming device to cut the at least one thread used to perform the at least one stich.

The control unit 109, 110 is further configured to cause 315 a relative movement between the needle of the thread consuming device and the sub-frame 34. In one embodiment, this is performed by causing the movable stage 2*b* to move the frame 30. In yet one embodiment, the control unit 109, 110 is configured to cause a movement of the needle of the thread consuming device 15.

Once the needle and the sub-frame 34 are in place relative each other, the control unit 109, 110 is further configured to cause 320 the thread consuming device to perform at least one residual stich on the residual fabric 3*b*.

Once the residual stich(es) are made into the fabric 3*b*, the control unit 109, 110 is configured to cause 325 the thread consuming device 15 to cut the at least one thread 20 used to perform the at least one residual stich.

The control unit 109, 110 is further configured to cause 330 a relative movement between the needle of the thread consuming device and the main frame 32. In one embodiment, this is performed by causing the movable stage 2*b* to move the frame 30. In yet one embodiment, the control unit 109, 110 is configured to cause a movement of the needle of the thread consuming device 15.

The method of cutting the thread is also applicable to underlay stiches.

Further alternative aspects of the present disclosure are described in the following examples.

An embroidery frame 30 to be used with a system for in-line treatment of a thread and a thread consuming device 15 is provided. The embroidery frame 30 comprises: a main frame 32 configured to receive a first portion of one or more substrates, wherein the first portion is to be produced with a decorative thread pattern, and at least one sub-frame configured to receive second portion of the one or more substrates, wherein the second portion is a residual substrate.

The sub-frame has a dimension smaller than the main frame 32. The dimensions of the main frame 32 and the at least one sub-frame may be adaptable in relation to each other.

The substrate of the sub-frame is configured to receive at least one unwanted/residual stich.

The at least one unwanted/residual stich is related to a color transition.

The embroidery frame 30 is configured to be arranged on a movable stage 2*b* so that the substrate in the embroidery frame 30 is movable in relation to the thread consuming device 15.

A control unit 109, 110 is configured to cause a relative movement between a needle of the thread consuming device 15 and the sub-frame, or cause a relative movement between a needle of the thread consuming device 15 and the main frame 32.

The control unit 109, 110 is further configured to: cause the thread consuming device 15 to perform at least one stich, with the at least one thread using the at least one needle, and the on the substrate 3*a*, that is to be produced with a decorative thread pattern, arranged in the main frame 32, cause the thread consuming device 15 to cut said at least one thread used to perform the at least one stich, cause a relative movement between a needle of the thread consuming device 15 and the sub-frame, cause the thread consuming device 15 to perform at least one residual stich on the residual substrate 3*b*, cause the thread consuming device 15 to cut said at least one thread used to perform the at least one residual stich, and cause a relative movement between a needle of the thread consuming device 15 and the main frame 32.

A system for in-line treatment of thread for use with a thread consuming device 15, comprising an embroidery frame 30 is provided. The system is in operative communication with a control unit 109, 110 being configured to: cause a relative movement between a needle of the thread consuming device 15 and the sub-frame, or cause a relative movement between a needle of the thread consuming device 15 and the main frame 32.

As should be understood by a person skilled in the art, different variations of these examples are covered by the inventive concept. For example, the treatment unit 100 may be arranged with one control unit 110*a* whereas the tread consuming device 15 only relies on the external control unit 110*c*. Moreover, the movable stage 2*b* may be arranged with a separate control unit although not shown.

Although the present disclosure has been described above with reference to specific examples, it is not intended to be limited to the specific form set forth herein. Rather, the disclosure is limited only by the accompanying clauses. As is understood by the skilled person, an example as defined herein may be interpreted as an embodiment of the disclosure.

The term "comprises/comprising" does not exclude the presence of other elements or steps. Additionally, although individual features may be included in different clauses, these may possibly advantageously be combined, and the inclusion in different clauses does not imply that a combination of features is not feasible and/or advantageous. In addition, singular references do not exclude a plurality. The terms "a" "an", "first", "second" etc., do not preclude a plurality. Reference signs in the clauses are provided merely as a clarifying example and shall not be construed as limiting the scope of the clauses in any way.

The invention claimed is:

1. A computer-implemented method for generating thread stitch coloring data for an in-line thread coloring process, comprising:

obtaining first thread stitch coloring data based on a digital representation that is to be produced as a decorative thread pattern, the first thread stitch coloring data having a set of color representations, wherein each color representation of the set of color representations is assigned to a respective thread source representation of a set of thread source representations;

obtaining at least one thread color boundary from the first thread stitch coloring data, each thread color boundary defining a color change from a first color to a second color among said set of color representations;

determining residual stitch data based on the at least one thread color boundary, the residual stitch data being indicative of a number of residual stitches required in order to carry out said color change in the in-line thread coloring process;

generating second thread stitch coloring data based on the residual stitch data such that the color change of the first thread stitch coloring data is accounted for in the in-line thread coloring process, the second thread stitch coloring data having a set of color representations assigned to a single thread source representation; and controlling, based on the second thread stitch coloring data, the in-line thread coloring process.

2. The method of claim 1, wherein determining the residual stitch data comprises estimating the number of residual stitches to carry out said color change, wherein the residual stitches are adapted to be carried out on a residual substrate different from a substrate where the decorative thread pattern is to be produced.

3. The method of claim 2, wherein the substrate is adapted to be received by a main frame and the residual substrate is adapted to be received by at least one sub-frame.

4. The method of claim 1, wherein the residual stitch data is determined by estimating a number of residual stitches adapted to be carried out as underlay stitches on a substrate where the decorative thread pattern is to be produced.

5. The method (200) of claim 2, wherein the estimation of the number of residual stitches depends on one or more operating conditions of the in-line thread coloring process.

6. The method of claim 1, wherein determining the residual stitch data comprises defining a thread color boundary range indicating a range of residual stitches having intermediary colors between the first color and the second color, the thread color boundary range having a starting value being indicative of an initiation of the color change, and an end value being indicative of a completion of the color change.

7. The method of claim 6, further comprising setting a respective buffer to each one of the starting value and the end value, the buffers indicating additional number of stitches to the residual stitch data on a respective end of the thread color boundary range.

8. The method of claim 6, wherein the thread color boundary range is dependent on one or more of a number of stitches, an amount of consumed thread, a substrate property, a thread property, and a combination thereof.

9. The method of claim 1, wherein said color change is caused by one or more of a color transition in the digital representation, a cutting process of a thread, a relative movement of a substrate, and a combination thereof.

10. The method of claim 1, wherein the residual stitch data comprises information of one or more of a length of the color change, a direction of residual stitches used in carrying out said color change, a substrate property where the color change is to be carried out, a thread property of a thread to be used for carrying out the color change, and a combination thereof.

11. The method of claim 1, wherein controlling the in-line thread coloring process comprises, based on the second thread stitch coloring data, causing control of the in-line thread coloring process by:

controlling an in-line thread coloring process of a thread;

controlling a thread consumption process of the thread with respect to a substrate; and controlling a residual embroidery process of the thread as one or both of residual stitches onto a residual substrate different from the substrate, and residual stitches as underlay stitches onto the substrate.

12. The method of claim 1, wherein generating the second thread stitch coloring data comprises:

obtaining pattern data from the digital representation, the pattern data comprising a plurality of pixels, each pixel being associated with a position in the digital representation and a color value;

generating resolution data by processing the pattern data, wherein processing the pattern data comprises determining a thread arrangement comprising a plurality of stitches, wherein the thread arrangement corresponds to a digital representation to be produced in the in-line thread coloring process; and generating the second thread stitch coloring data for the thread at least based on said resolution data.

13. The method of claim 12, wherein processing the pattern data further comprises determining information relating to a length of the stitches, a direction of the stitches and a type of connection used to connect one or more stitches to each other.

14. A control unit comprising a processor configured to carry out the steps of the method of claim 1.

15. A system for in-line treatment of at least one thread for use with a thread consuming device, the system comprising:

a treatment unit comprising at least one discharge device comprising at least one nozzle, arranged along the at least one thread, being configured to dispense one or more coating substances onto the at least one thread when activated; and a control unit configured to control the discharge device to dispense the coating substances onto the at least one thread based on the second thread stitch coloring data generated from the method of claim 1.

16. A non-transitory computer-readable storage medium comprising instructions, which when executed by one or more processors of a control unit, cause the processors to:

obtain first thread stitch coloring data based on a digital representation that is to be produced as a decorative thread pattern, the first thread stitch coloring data having a set of color representations, wherein each color representation of the set of color representations is assigned to a respective thread source representation of a set of thread source representations;

obtain at least one thread color boundary from the first thread stitch coloring data, each thread color boundary defining a color change from a first color to a second color among said set of color representations;

determine residual stitch data based on the at least one thread color boundary, the residual stitch data being indicative of a number of residual stitches required in order to carry out said color change in the in-line thread coloring process; and generate second thread stitch coloring data based on the residual stitch data such that the color change of the first thread stitch coloring data is accounted for in the in-line thread coloring process, the second thread stitch coloring data having a set of color representations assigned to a single thread source representation; and control, based on the second thread stitch coloring data, the in-line thread coloring process.

17. A computer program product comprising computer code for performing functionality of the method of claim 1.

18. The method of claim 1, wherein controlling the in-line thread coloring process comprises:

dispensing, by at least one nozzle arranged along the at least one thread, one or more coating substances based on the second thread stitch coloring data.

* * * * *